US011730268B2

(12) United States Patent
Crum et al.

(10) Patent No.: US 11,730,268 B2
(45) Date of Patent: Aug. 22, 2023

(54) ROCKER RECLINING MECHANISM FOR A ROCKER RECLINER ROCKING BETWEEN THE ARMS

(71) Applicant: L&P PROPERTY MANAGEMENT COMPANY, South Gate, CA (US)

(72) Inventors: Michael Andrew Crum, Mantachie, MS (US); Gregory Mark Lawson, Tupelo, MS (US); Cheston Brett Crawford, Randolph, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 17/993,060

(22) Filed: Nov. 23, 2022

(65) Prior Publication Data

US 2023/0085728 A1 Mar. 23, 2023

Related U.S. Application Data

(62) Division of application No. 17/316,932, filed on May 11, 2021, now Pat. No. 11,528,993.

(60) Provisional application No. 63/039,175, filed on Jun. 15, 2020.

(51) Int. Cl.

| | |
|---|---|
| ***A47C 1/02*** | (2006.01) |
| ***A47C 1/024*** | (2006.01) |
| ***A47C 1/032*** | (2006.01) |
| ***A47C 1/035*** | (2006.01) |
| ***A47C 1/0355*** | (2013.01) |

(52) U.S. Cl.

CPC ..... *A47C 1/0355* (2013.01)

(58) Field of Classification Search

None

See application file for complete search history.

(56) References Cited

U.S. PATENT DOCUMENTS

| | | | |
|---|---|---|---|
| 4,662,673 | A | 5/1987 | Crum |
| 4,707,025 | A | 11/1987 | Rogers, Jr. |
| 5,876,094 | A | 3/1999 | Hoffman |
| 6,000,758 | A | 12/1999 | Schaffner et al. |
| 6,142,558 | A | 11/2000 | May |
| 6,634,706 | B2 | 10/2003 | May |
| 6,659,556 | B2 | 12/2003 | Pellerin |
| 6,945,599 | B2 | 9/2005 | May |
| 7,021,711 | B1 | 4/2006 | Hoffman et al. |
| 7,497,512 | B2 | 3/2009 | White et al. |

(Continued)

OTHER PUBLICATIONS

International Search Report and Written Opinion received for PCT Patent Application No. PCT/US2021/037348, dated Nov. 4, 2021, 11 pages.

(Continued)

*Primary Examiner* — Shin H Kim

(74) *Attorney, Agent, or Firm* — Shook Hardy & Bacon, LLP

(57) ABSTRACT

A rocker recliner is disclosed that has a pair of stationary arms; a seat disposed between the arms; an ottoman; a back coupled to the seat. A full-recline linkage mechanism couples the ottoman, the seat and the back and is operable to move the ottoman, the seat and the back between a closed position, a TV position and a fully reclined position. A rocker assembly is coupled between the full-recline linkage mechanism and the stationary arms that allows the seat, back and ottoman to rock between the stationary arms in any of the closed position, the TV position or the fully reclined position.

20 Claims, 21 Drawing Sheets

(56) References Cited

U.S. PATENT DOCUMENTS

| | | | |
|---|---|---|---|
| 7,543,885 | B2 | 6/2009 | Pollard et al. |
| 8,113,574 | B2 | 2/2012 | Hoffman et al. |
| 8,398,165 | B2 | 3/2013 | Lawson |
| 8,459,732 | B2 | 6/2013 | Lapointe et al. |
| 8,459,733 | B2 | 6/2013 | Hoffman et al. |
| 8,616,627 | B2 | 12/2013 | Murphy et al. |
| 8,752,890 | B2 | 6/2014 | Murphy et al. |
| 8,833,844 | B2 | 9/2014 | Lapointe et al. |
| 8,911,009 | B2 | 12/2014 | Hoffman et al. |
| 8,967,718 | B2 | 3/2015 | Hoffman et al. |
| 9,351,890 | B2 | 5/2016 | Hough et al. |
| 9,743,770 | B1 | 8/2017 | Pollard et al. |
| 10,349,748 | B2 | 7/2019 | Marquez |
| 10,750,869 | B2 | 4/2020 | Robinson et al. |
| 10,653,243 | B2 | 5/2020 | Lawson et al. |
| 10,709,246 | B2 | 7/2020 | Murphy |
| 11,134,781 | B2 | 10/2021 | Robinson |
| 11,241,094 | B2 | 2/2022 | Murphy |
| 11,266,245 | B2 | 3/2022 | Lawson et al. |
| 2004/0000803 | A1 | 1/2004 | Guillot et al. |
| 2010/0127538 | A1 | 3/2010 | Hoffman et al. |
| 2012/0112517 | A1 | 5/2012 | Hoffman et al. |
| 2012/0112518 | A1 | 5/2012 | Murphy et al. |
| 2012/0146364 | A1 | 6/2012 | Hoffman et al. |
| 2013/0200659 | A1 | 8/2013 | Hoffman et al. |
| 2014/0327282 | A1 | 11/2014 | Crum |
| 2015/0076881 | A1 | 5/2015 | Lapointe |
| 2016/0106220 | A1 | 4/2016 | Bryant et al. |
| 2020/0275781 | A1 | 9/2020 | Lawson et al. |

OTHER PUBLICATIONS

International Preliminary Report on Patentability received for PCT Application No. PCT/US2021/037348, dated Dec. 29, 2022, 9 pages.

ROCKER RECLINING MECHANISM FOR A ROCKER RECLINER ROCKING BETWEEN THE ARMS

CROSS-REFERENCE TO RELATED APPLICATION

This application claims priority to U.S. Provisional Application No. 63/039,175 (filed Jun. 15, 2020), and U.S. patent application Ser. No. 17/316,932 (filed May 11, 2021) both of which are entitled Rocker Recliner Mechanism for a Rocker Recliner Rocking Between the Arms, both of which are incorporated herein by reference in their entireties.

BACKGROUND OF THE INVENTION

The present invention relates broadly to rocker, motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "rocker recliners." More particularly, the present invention relates to an improved mechanism allowing a rocking motion between the arms, with a power reclining mechanism developed to accommodate a wide variety of styling for a rocker recliner which is otherwise limited by the configurations of recliner mechanisms in the field.

Rocker recliners exist that allow a user to rock a chair forward and backward, and to forwardly extend a footrest and to recline the chair back relative to the seat. These existing rocker recliners typically provide three basic positions: a normal non-reclined sitting position with the seat generally horizontal and the back substantially upright; a partially reclined position often referred to as a "TV" position wherein the seat and back are disposed in a slightly reclined position but with the back still sufficiently upright to permit comfortable television viewing from the rocker recliner; and a fully reclined position wherein the back is pivoted toward horizontal into an obtuse relationship with the seat for lounging or sleeping. However, in these prior mechanisms, the arms rock with the remainder of the chair. It would be advantageous to construct a chair allowing the rocking motion, and the reclining features, without rocking the arms as well. In other words, it would be desirable to allow the seat and back to rock between the arms, with the arms being stationary components. This allows a "wood-to-the-floor" design. It is also desirable to have a mechanism that allows a winged back and a T-cushion style seat, allowing a number of different styles.

BRIEF SUMMARY OF THE INVENTION

One aspect of the present invention seeks to provide a simplified, compact, recliner mechanism which can be adapted to essentially any type of rocker recliner. At a high level, the seat, the footrest (or ottoman) and the back of the rocker recliner rock between the arms, with the arms remaining stationary during rocking. The mechanism provides a powered movement from the closed position, to the TV position and to the fully-reclined position by utilizing a linear actuator or motor (e.g., an electrically-driven extension rod) to control the position of the recliner mechanism and thus the rocker recliner. The rocker assembly allows the seat, the footrest and the back of the rocker recliner to rock between the arms in any position. This provides a chair that has stationary arms (or "wood to the floor") with a seat, and ottoman and a back that rock between the arms. The back is pivotally coupled to the seat through the full recline linkage mechanism in such a position that the back can be configured to have a wing that extends over the arm, but that also provides clearance to the back to allow it (and the wings) to both rock and recline without interference from the arms. The seat is moved forwardly as the rocker recliner is moved to a TV position or a fully reclined position, allowing a T-cushion style seat to be employed. In some aspects, the front of the seat may be raised relative to the back of the seat, allowing for a different rocking "feel" of the rocker recliner. Additionally, some components allow adjustability for furniture designers to balance the rocker recliner for the feel they desire.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
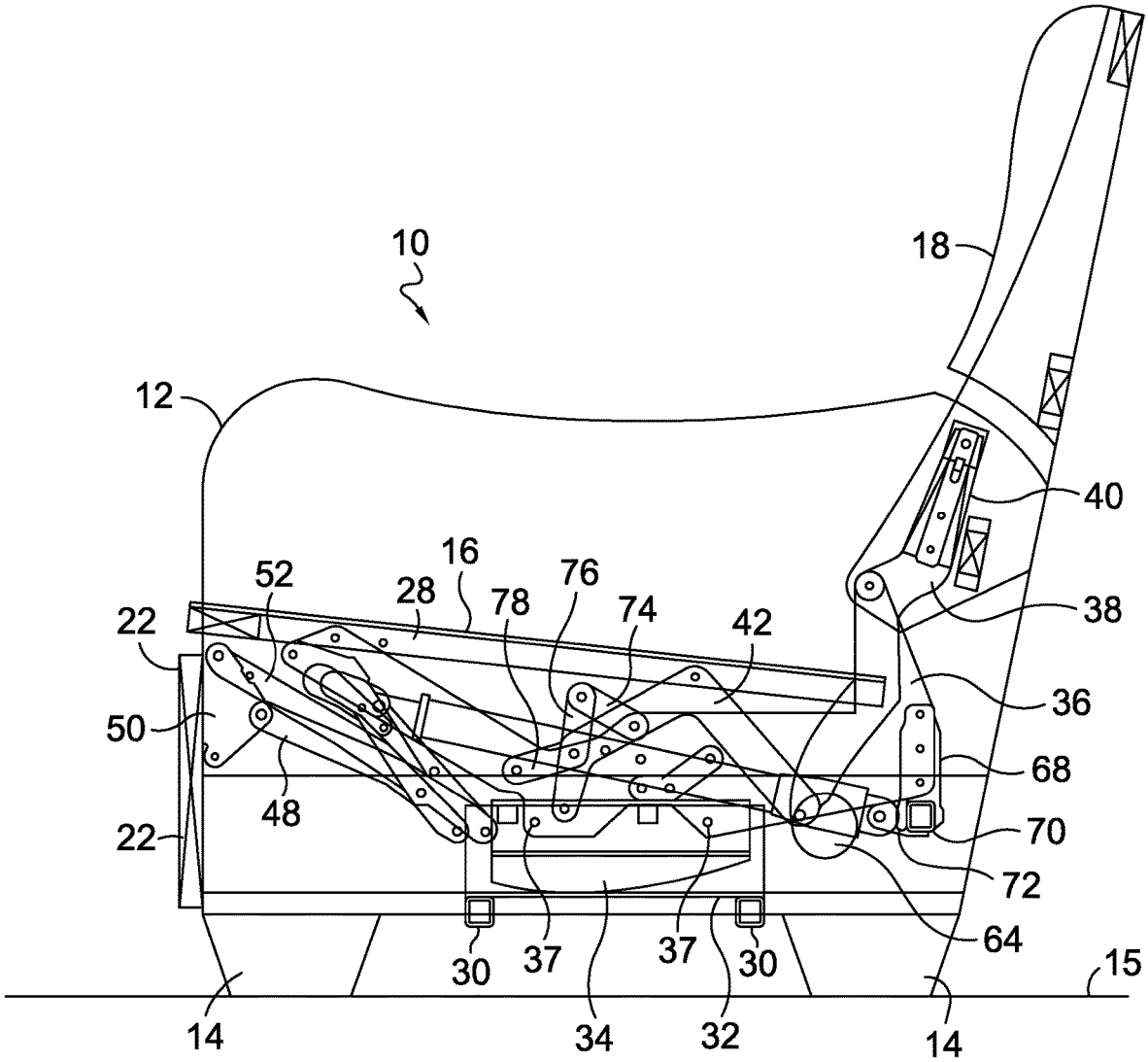
FIG. 1 is a side view of a rocker recliner with a rocking reclining mechanism, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical, and may be indicated by reference characters X, Y, and Z, respectively, in the accompanying figures. For example, the terms "vertical" and "vertically" as used herein refer to a direction perpendicular to each of the lateral and longitudinal axes. As a further example, the longitudinal axis may extend in a front-to-back direction of a rocker recliner and the lateral axis may extend in a side-to-side direction of the rocker recliner. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

FIGS. 1-6 illustrate a rocker recliner 10. As shown in FIG. 1, the rocker recliner 10 includes a pair of arms 12 supported by legs 14 on a seating support surface 15. A seat 16 and a back 18 are separately coupled to the rocker recliner 10 by a full-recline linkage mechanism 20. One or more ottomans 22 (e.g., a foot support ottoman, a leg support ottoman, a footrest etc.) may also be coupled to the rocker recliner 10 by the full-recline linkage mechanism 20 through a footrest linkage assembly 24 (best seen in FIG. 6). The back 18 is illustrated as a winged back and in operation, the back 18 is configured to pivot over the arms 12. Each of the arms 12, the seat 16, the back 18, and the one or more ottomans 22 may include one or more frame members 26 to which upholstery may be applied. Not all of the one or more frame members 26 are labeled in FIG. 1. While it appears that several of the one or more frame members 26 (e.g., at the arm 12 and the back 18) may interfere with one another when the back 18 is reclined, it is apparent from FIGS. 3-5 that said frame members do not interfere and include a stylized design having varied vertical heights in the longitudinal direction.

Figure 3:
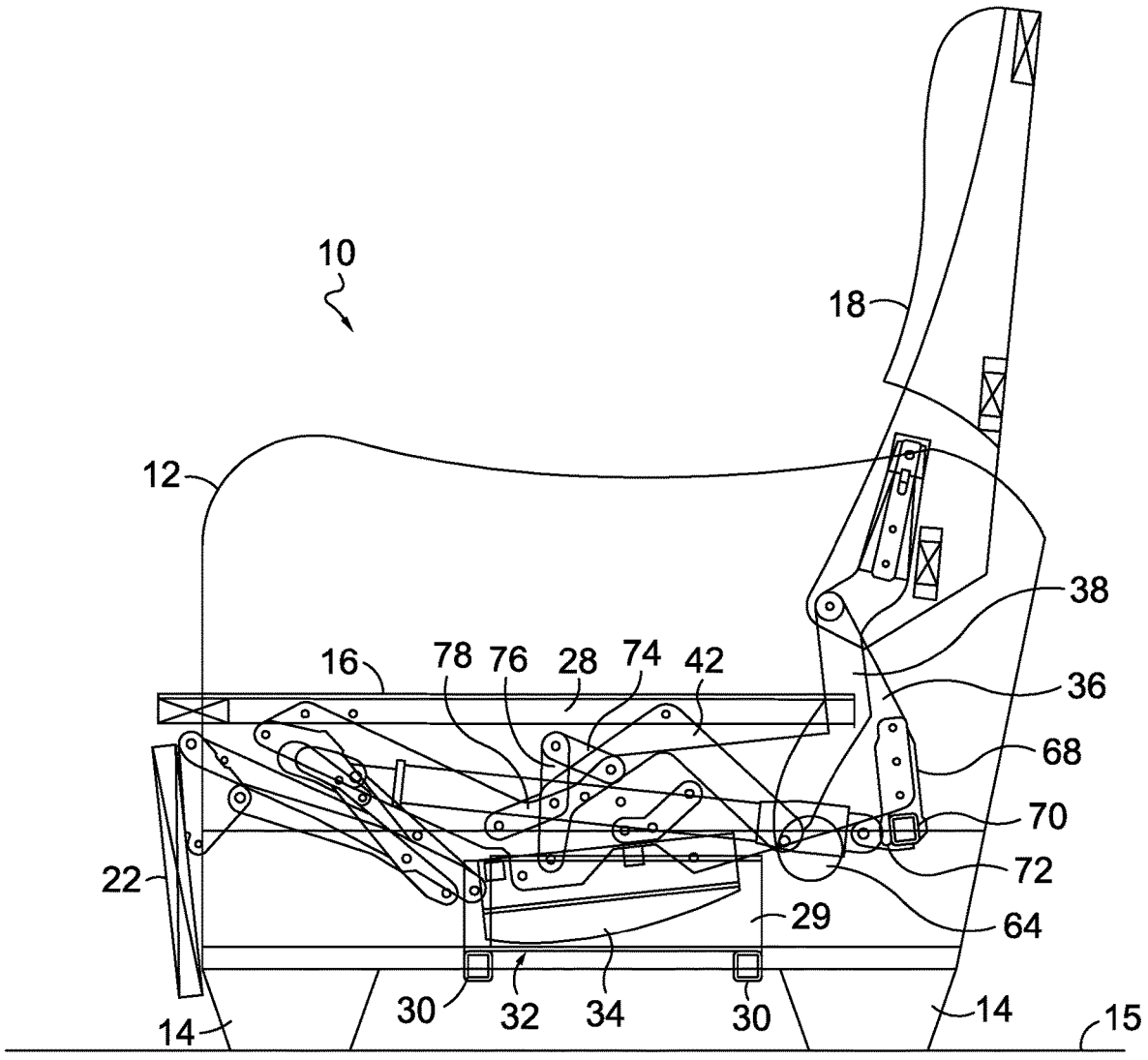
FIG. 3 is a view of the rocker recliner of FIG. 1 rocking forwardly, in accordance with aspects hereof.
Figure 4:
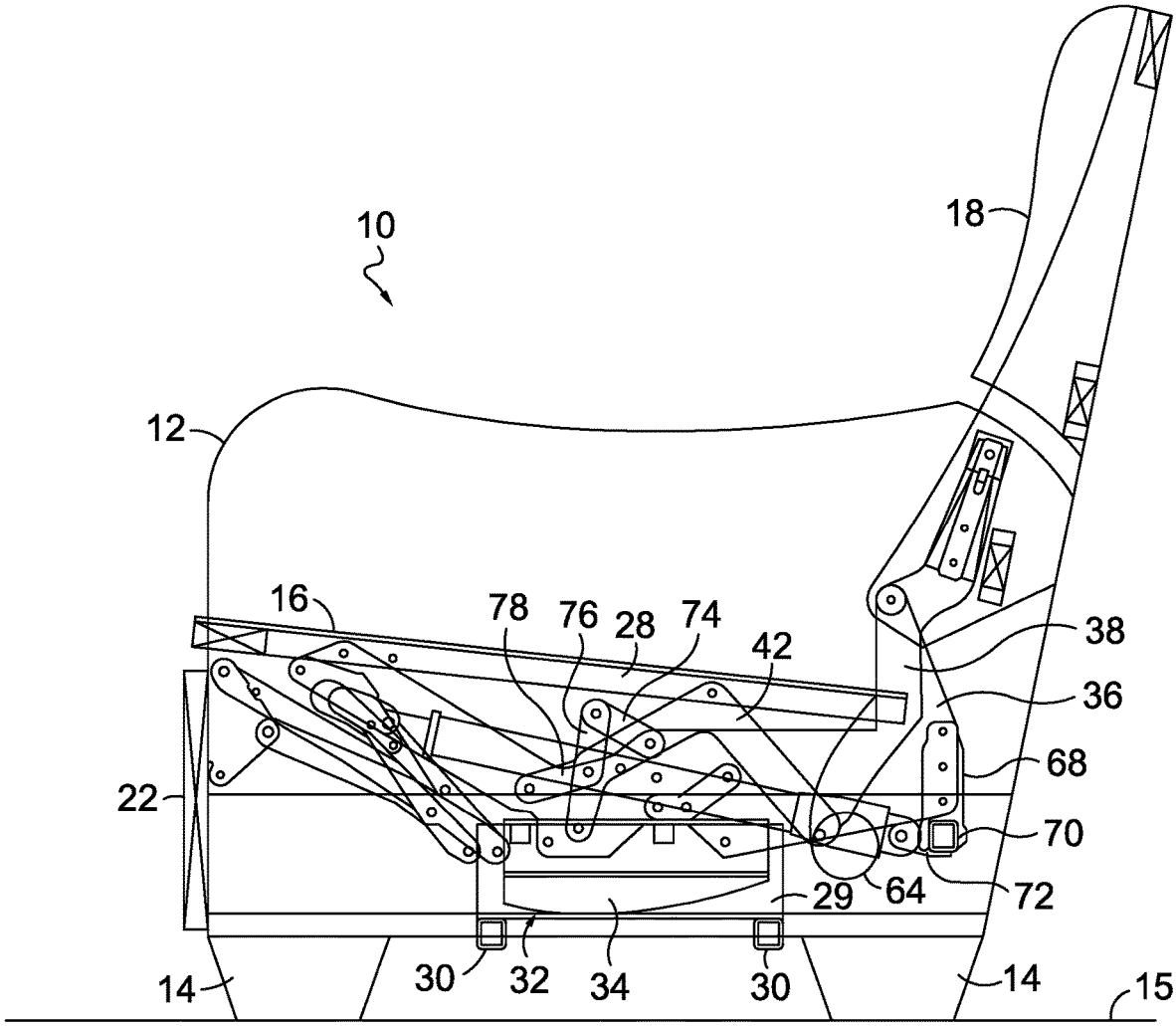
FIG. 4 is the same view as FIG. 1, in the closed position, in accordance with aspects hereof.
Figure 5:
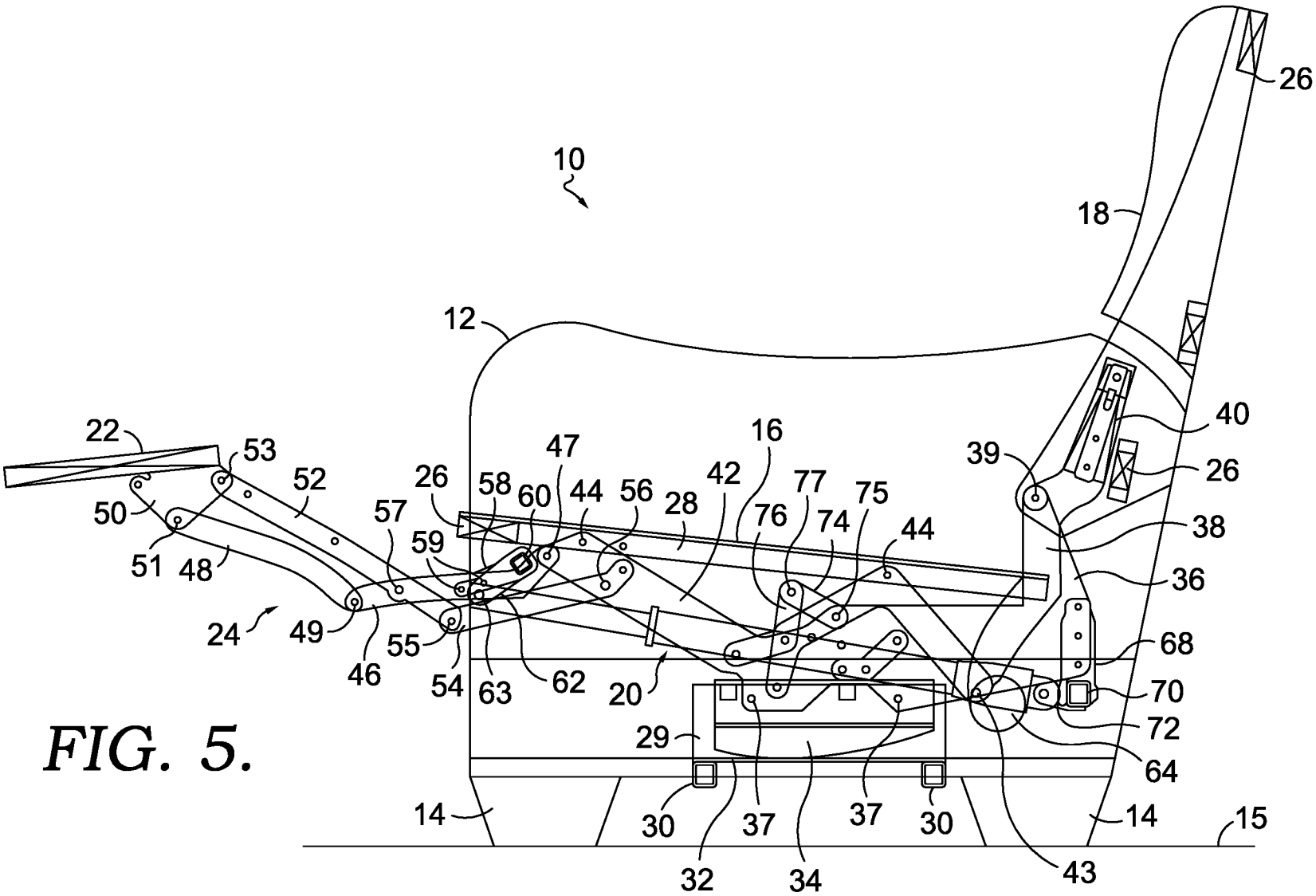
FIG. 5 is a side view of the rocker recliner of FIG. 4 in a TV position, in accordance with aspects hereof.
Figure 6:
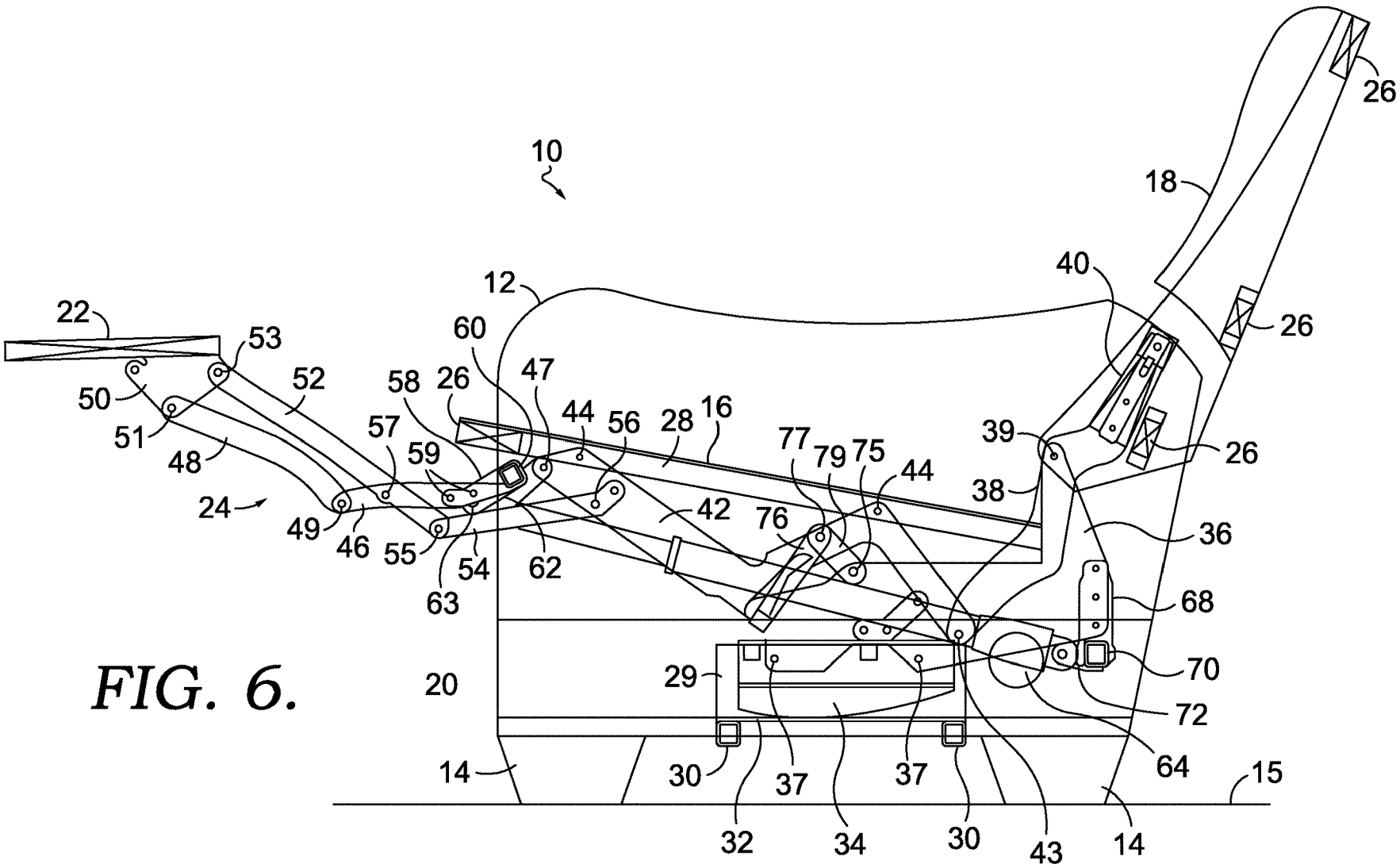
FIG. 6 is a side view of the rocker recliner of FIG. 4 in a fully reclined position, in accordance with aspects hereof.

FIGS. 4-6 illustrate side views of the rocker recliner 10 in a closed position (FIG. 4), a TV position (FIG. 5), and a fully reclined position (FIG. 6). The upholstery of seat 16 has been removed for clarity. The seat 16 is carried on a seat rail 28 connected to the full-recline linkage mechanism 20. The arms 12 and the legs 14 support the full-recline linkage mechanisms 20, the seat rail 28 and the seat 16 on the seating support surface 15. In one aspect, the legs 14 support the arms 12 and raise the arms 12 above the seating support surface 15. In other aspects, the arms 12 may contact the seating support surface 15 directly and the rocker recliner 10 may have no legs 14. The full-recline linkage mechanism 20 is arranged to allow the seat 16, the back 18 and the ottoman(s) 22 to rock between the arms 12, and to actuate and control movement of the seat 16, the back 18, and the one or more ottomans 22 between the positions shown in FIGS. 1-6, as more fully described below.

Figure 2:
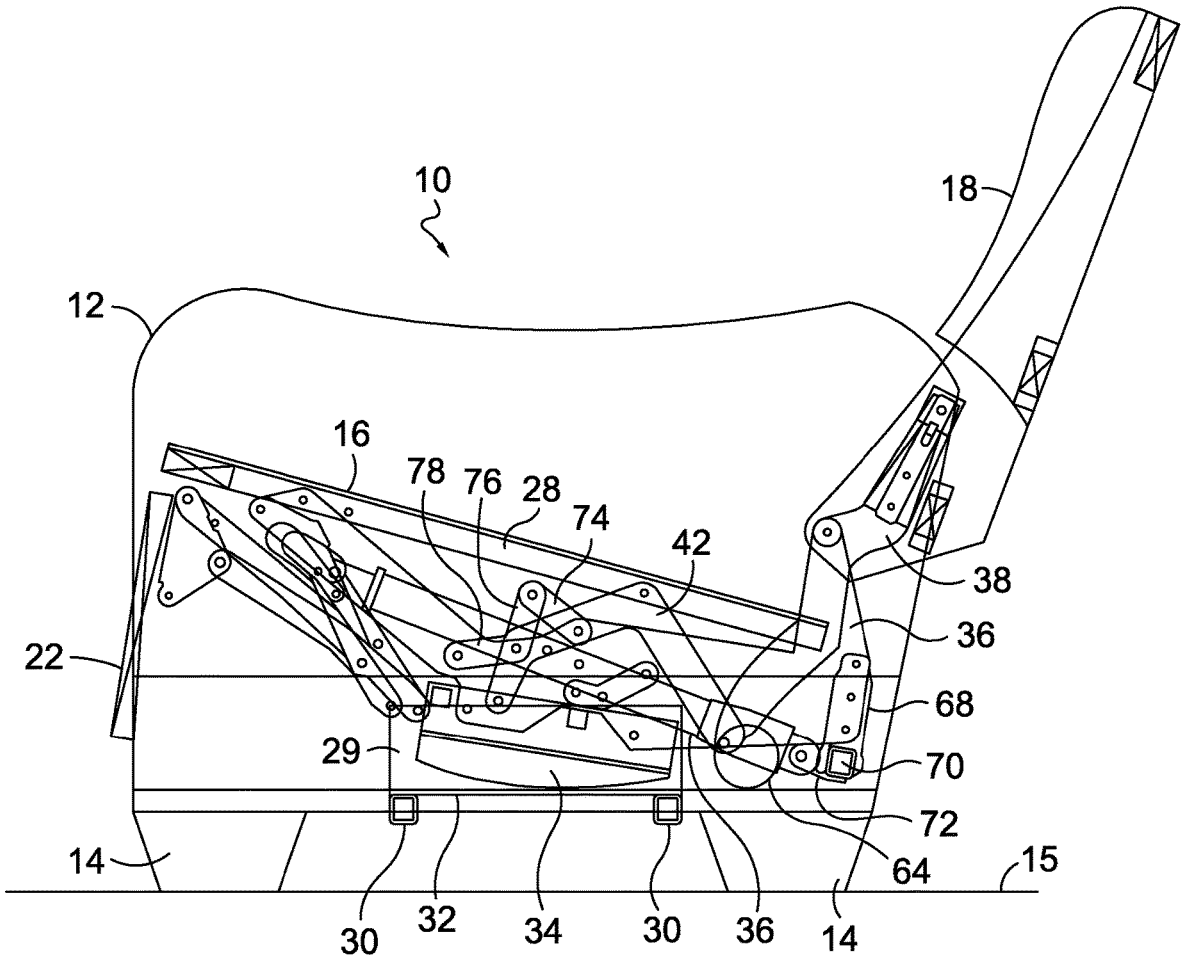
FIG. 2 is a view of the rocker recliner of FIG. 1 rocking rearwardly, in accordance with aspects hereof.

As shown in FIGS. 4-6, the rocker recliner 10 is adjustable to three basic positions. FIG. 4 depicts a closed position, which is a normal non-reclined sitting position with the seat 16 in a generally horizontal position and the back 18 substantially upright. In the closed position, the one or more ottomans 22 are positioned below the seat 16. FIG. 5 depicts a TV position (also referred to as an extended position in the furniture manufacturing industry) in which the one or more ottomans 22 are extended forward of the front of the rocker recliner 10 and disposed generally horizontal. Only one ottoman 22 is present in the illustrated aspect, however, in other aspects one, two, or more ottomans may be coupled to the full-recline linkage mechanism 20. In the TV position, the position of the seat 16 remains substantially unchanged from the closed position. FIG. 6 depicts a fully reclined position in which the seat 16 and the one or more ottomans 22 have moved forward and upward. In the fully reclined position, the back 18 is rotated over the upper portion of arm 12 in a rearward inclination angle. The rearward inclination angle of the fully reclined position causes the back 18 to move rearwardly to some degree. The rocker recliner 10, in the closed position of FIG. 1 or FIG. 4 can "rock" rearwardly, as shown in FIG. 2 and forwardly, as shown in FIG. 3. During this rocking motion, as described in detail below, the seat 16, the back 18 and the ottoman(s) 22 rock, while the arms 12 remain stationary. While not depicted, this same rocking motion is available in all positions of the rocker recliner 10, including the TV position and the fully reclined position.

The rocker recliner 10 is more fully described below. Most of this discussion will describe one side of the rocker recliner 10, but it should be understood that much of full-recline linkage mechanism 20 has a left side and a ride side that are mirror-images of each other. For simplicity, only one side is described below. The rocker recliner 10 has a chassis plate 29 coupled to an adjacent arm 12, and a pair of support tubes 30 that extend between arms 12 and that are coupled to the chassis plate 29. The support tubes 30 are coupled to a rocker plate 32. The tubes 30 can be, in one aspect, rigid steel or aluminum square tubes, and the rocker plate 32 can be flat steel. A rocker cam 34 having an arcuate lower surface rests upon the rocker plate 32. In some aspects, the rocker cam 34 is biased to the neutral position of FIG. 1 with a series of springs (not shown) as is known in the furniture industry. The springs provide a returning force when the rocker recliner 10 moves to a rearward rocking position (FIG. 2) or a forward rocking position (FIG. 3).

The full-recline linkage mechanism 20 includes a base plate 36 and is fixedly coupled to the rocker cam 34 at connection points 37. The base plate 36 extends from about the front of the rocker cam 34 rearwardly to near the back of the rocker recliner 10. A back mounting bracket 38 is pivotally coupled to the upper rearward end of the base plate 36 at pivot point 39. The upper end of the back mounting bracket 38 is coupled to the back 18, such as with a KD bracket 40, allowing the back 18 to be easily assembled onto the back mounting bracket 38. The lower end of the back mounting bracket 38 is pivotally coupled to a seat plate 42 at pivot point 43.

The seat plate 42 has a zig-zag shape and is fixedly coupled to the seat rail 28 at connection points 44. The forward end of the seat plate 42 is coupled to the footrest linkage assembly 24. More specifically, a front ottoman link 46 is pivotally coupled to the seat plate 42 at pivot point 47. The front ottoman link 46 extends away from pivot point 47 and is pivotally coupled at the opposite end to a lower ottoman link 48 at pivot point 49. The end of the lower ottoman link 48 opposite pivot point 49 is pivotally coupled to a footrest bracket 50 at pivot point 51. The footrest bracket 50 is fixedly coupled to the ottoman 22. An upper ottoman link 52 is also pivotally coupled to the footrest bracket 50, at pivot point 53. The upper ottoman link 52 extends away from pivot point 53, and is pivotally coupled on the opposite end to a rear ottoman link 54 at pivot point 55. The upper ottoman link 52 is also pivotally coupled to the front ottoman link 46, at pivot point 57. The end of the rear ottoman link 54 opposite pivot point 55 is pivotally coupled to the seat plate 42 at pivot point 56.

As best seen in FIGS. 5 and 6, a front motor tube bracket 58 is fixedly coupled to the front ottoman link 46 at coupling points 59. The front motor tube bracket 58 extends away from coupling points 59 and is fixedly coupled to a front motor tube 60. The front motor tube 60 extends from one side of the rocker recliner 10 to the other, coupling together opposing front motor tube brackets 58. A clevis 62 is used to pivotally couple the front motor tube 60 to the shaft of a motor or linear actuator 64 at pivot point 63.

A rear motor tube bracket 68 is fixedly coupled to the base plate 36, such as by bolting or riveting. A rear motor tube 70 is fixedly coupled between opposing rear motor tube brackets 68, and thus extends from one side of the rocker recliner 10 to the other. A clevis 72 is fixedly coupled to the rear motor tube 70, such as by welding. The clevis 72 is used to pivotally couple the rear end of the motor 64 to the rear motor tube 70.

Figure 7:
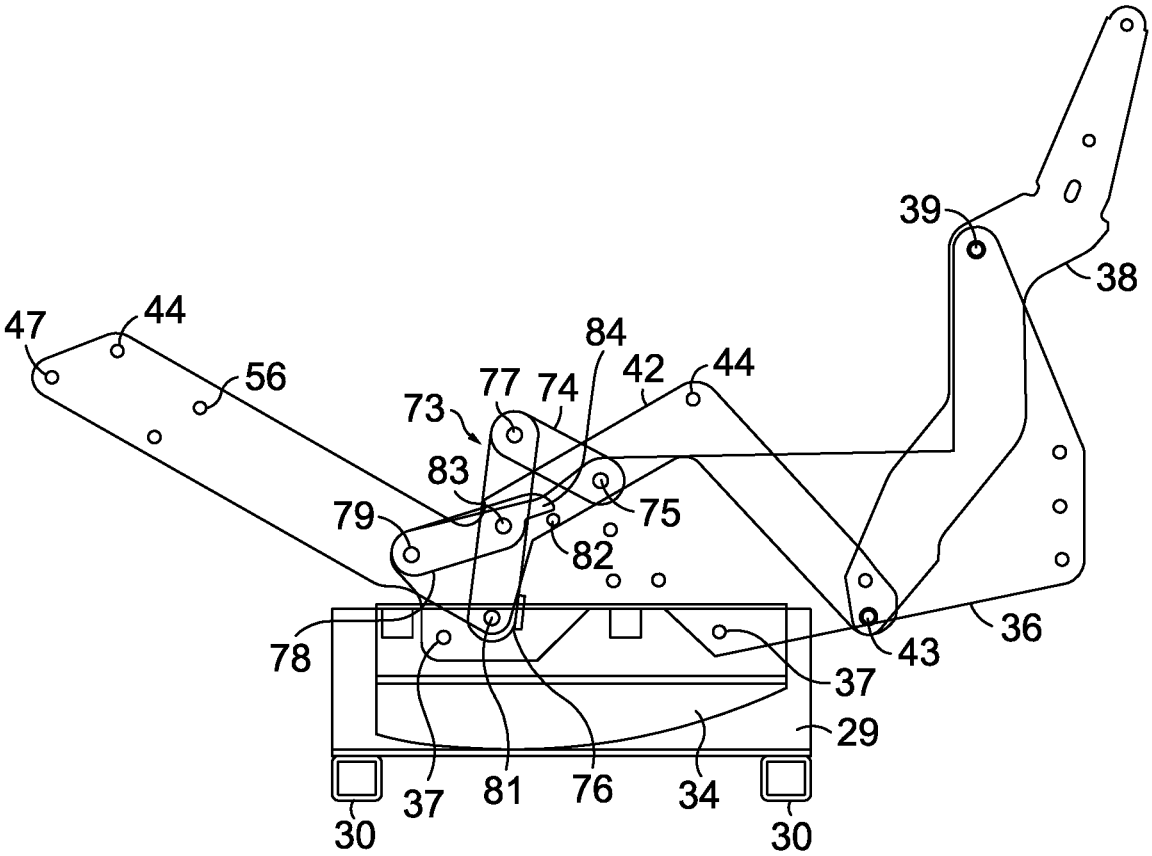
FIG. 7 is a partial view of only certain components of the rocker recliner mechanism, shown in the closed position, in accordance with aspects hereof.

As best seen in FIG. 7, a translation sub-linkage 73 is shown. The translation sub-linkage 73 includes a control link 74, a pivot link 76 and a pivot lift link 78. The control link 74 is pivotally coupled to the base plate 36 at pivot point 75. The control link 74 extends away from pivot point 75, and is pivotally coupled on the opposite end to the pivot link 76 at pivot point 77. The end of the pivot link 76 opposite pivot point 77 is pivotally coupled to the seat plate 42 at pivot point 81. The pivot lift link 78 is pivotally coupled on one end to the base plate 36 at pivot point 79. The other end of the pivot lift link 78 is pivotally coupled to the pivot link 76 at pivot point 83, generally midway between pivot point 77 and pivot point 81. Additionally, in some aspects, the pivot lift link 78 has a finger 84 that projects rearwardly beyond pivot point 83. The finger 84 on the pivot lift link 78 contacts a stop 82 on the base plate 36 when the rocker recliner 10 is in the closed or TV positions.

As can be seen by comparing FIG. 1 to FIG. 2, the rocker recliner 10 can be "rocked" rearwardly, under operator power, to recline the seat 16, the back 18 and the ottoman(s) 22 relative to the arms 12. More specifically, as a rearward force is applied to the back 18, the rocker cam 34 "rolls" on the rocker plate 32. The base plate 36, the seat plate 42 and the seat rail 28 follow this rocking motion, thus reclining the seat 16. The back 18 and the ottoman(s) 22 follow the seat 16 and rock with it, due to the connection of the back 18 and the ottoman(s) 22 to the seat 16 through the back mounting bracket 38 and the seat plate 42. A similar forward rocking motion is shown in FIG. 3. As described above, the rocker cam 34 is biased to return to a neutral position, such as with a spring plate and springs, as is known in the art of rocker mechanisms.

To extend the footrest from the closed position of FIGS. 1 and 4 to the TV position of FIG. 5, the motor 64 is activated (such as with a push-button operator control) to extend the shaft of the motor 64. As the shaft of the motor 64 extends forwardly, the front motor tube 60 rotates, thus rotating the front ottoman link 46. As the front ottoman link 46 rotates about pivot point 47, the footrest linkage assembly 24 opens to the position shown in FIG. 5. In this position, the back 18 and the seat 16 remain in substantially the same position. The rocker recliner 10 can rock forward and rearward while in the TV position of FIG. 5. To move the rocker recliner 10 from the TV position of FIG. 5 to the fully reclined position of FIG. 6, the motor 64 is again activated, to extend the shaft of the motor 64 farther. With the footrest linkage assembly 24 already open, the additional extension of the shaft of motor 64 pushes seat plate 42 forwardly and upwardly, with the front of the seat plate 42 rising more than the back of the seat plate 42, to impart an angle or pitch to the seat rail 28, and thus the seat 16. This motion is controlled, in part, by the pivot lift link 78, the pivot link 76 and the control link 74 of the translation sub-linkage 73. Additionally, as the seat plate 42 moves forwardly, it rotates the back mounting bracket 38 about pivot point 39, due to the pivotal connection of the seat plate 42 and the back mounting bracket 38 at pivot point 43. This, in turn, reclines the back 18. Again, the rocker recliner 10 can be rocked forward and rearward while in the fully reclined position of FIG. 6.

The full-recline linkage mechanism 20, the chassis plate 29 and the rocker assembly including the rocker cams 34 provide a simple, compact mechanism for a powered, rocker recliner that allows the seat 16, the back 18 and the ottoman(s) 22 to rock backward (FIG. 2) and forward (FIG. 3) between stationary arms 12 in any of a closed position, a TV position or a fully reclined position. This allows different styling options that may be favorable for customers that do not like the look and feel of a rocker in which the arms move with the seat and the back. Additionally, the rocker recliner 10 is not only a rocker, but a powered recliner mechanism as well, that allows a user powered movement between the closed, TV and fully reclined positions.

Figure 8:
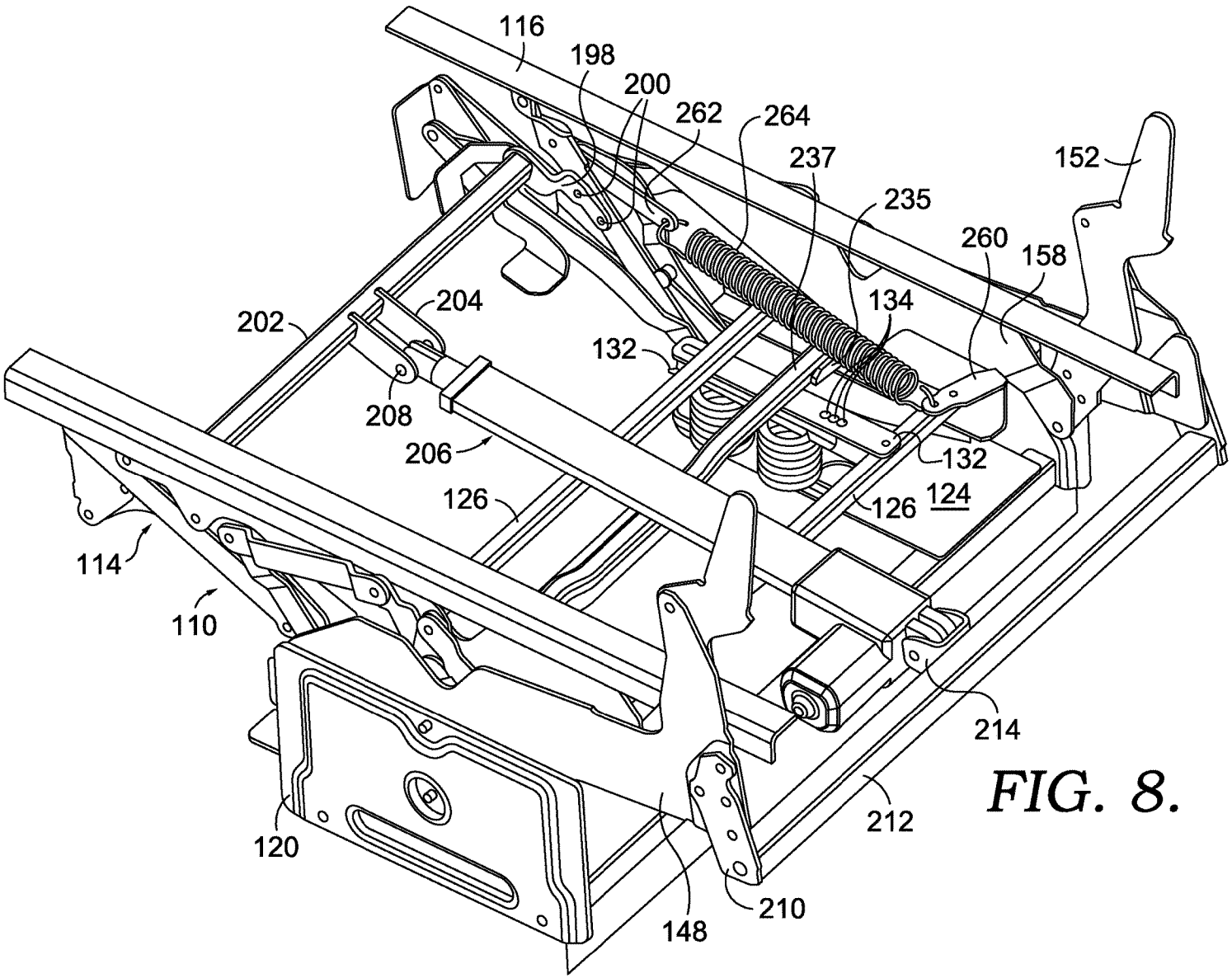
FIG. 8 is a perspective view of another aspect of a rocker recliner mechanism in the closed position, in accordance with aspects hereof.
Figure 9:
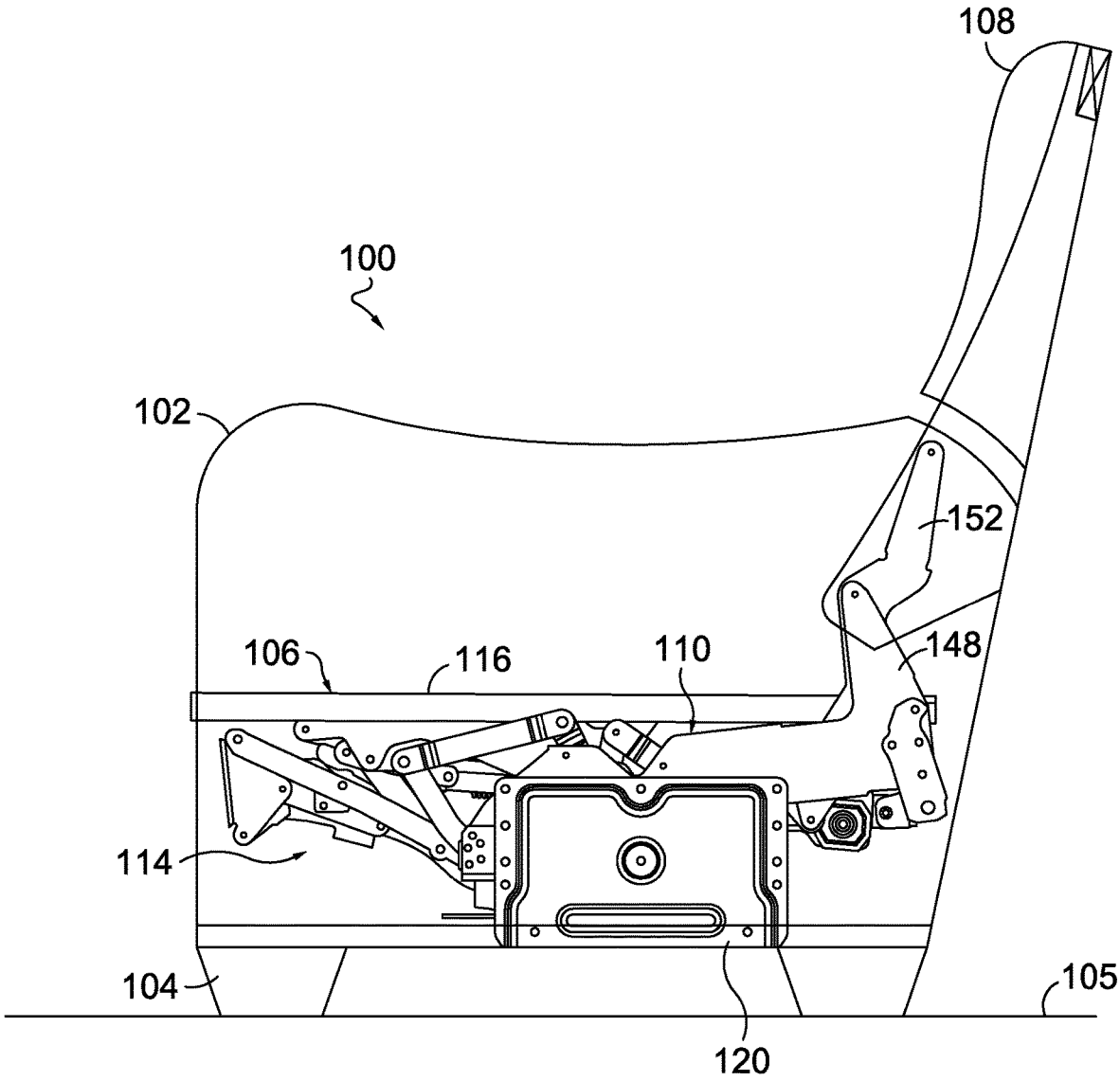
FIG. 9 is a side view of the rocker recliner mechanism shown in FIG. 8, in accordance with aspects hereof.

FIGS. 8-17 illustrate another aspect of a rocker recliner 100. As shown in FIG. 9, the rocker recliner 100 includes a pair of arms 102 supported by legs 104 on a seating supporting surface 105. A seat 106 and a back 108 are separately coupled to the rocker recliner 100 by a full-recline linkage mechanism 110. One or more ottomans 112 (e.g., a foot support ottoman, a leg support ottoman, a footrest etc.) may also be coupled to the rocker recliner 100 by the full-recline linkage mechanism 110 through a footrest linkage assembly 114 (best seen in FIG. 15). The back 108 is illustrated as a winged back and in operation, the back 108 is configured to pivot over the arm 102. Each of the arm 102, the seat 106, the back 108, and the one or more ottomans 112 may include one or more frame members to which upholstery may be applied.

Figure 12:
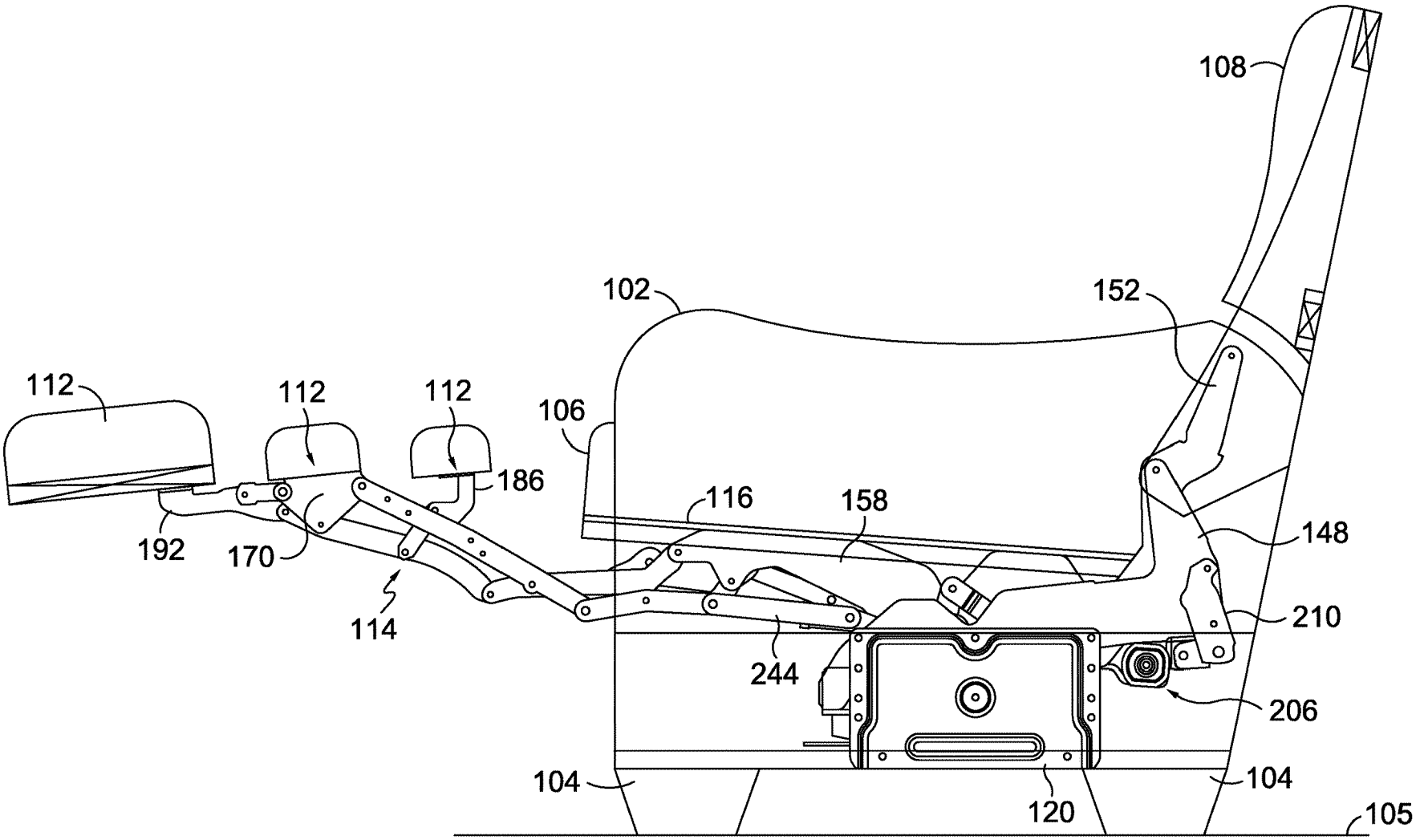
FIG. 12 is a side view of the rocker recliner mechanism of FIG. 8 in the TV position, in accordance with aspects hereof.
Figure 13:
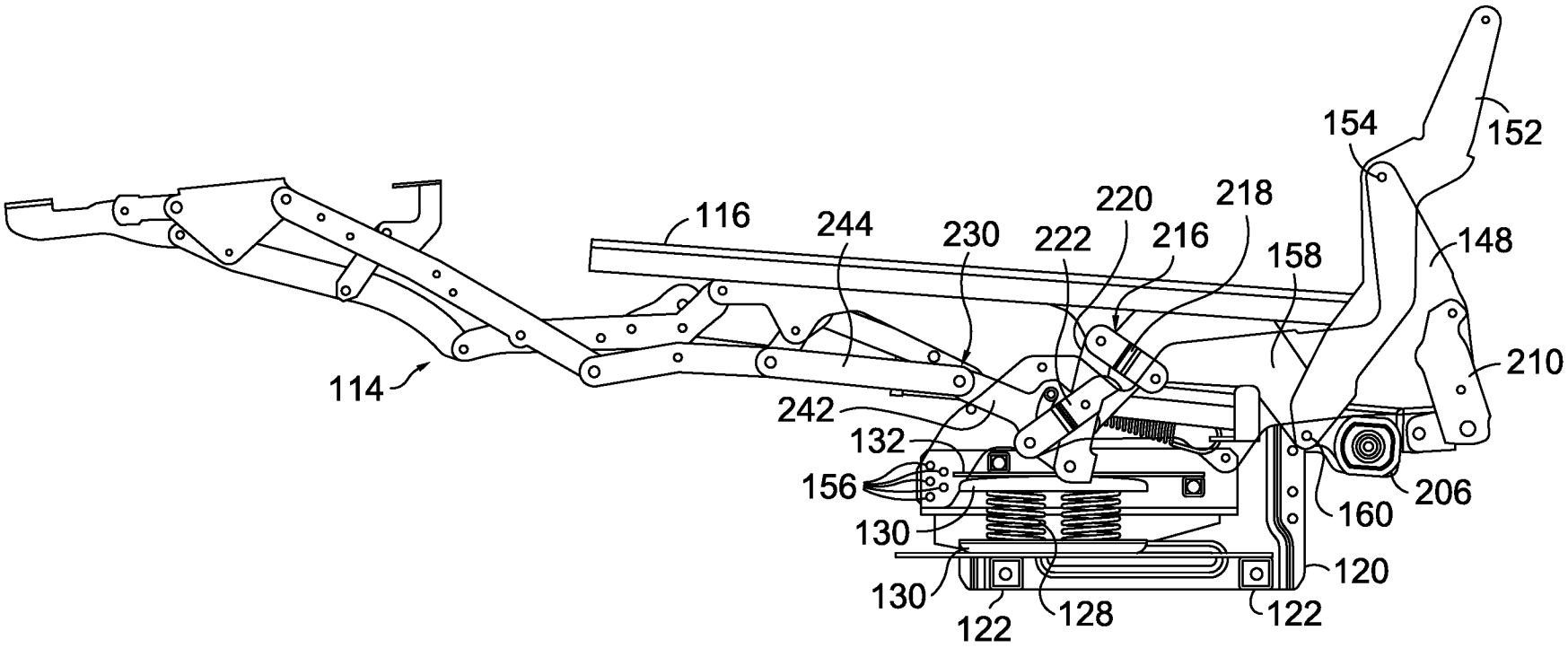
FIG. 13 is a view similar to FIG. 12 but with the chassis plate, cam angle bracket and wood cam hidden to show other parts, in accordance with aspects hereof.
Figure 14:
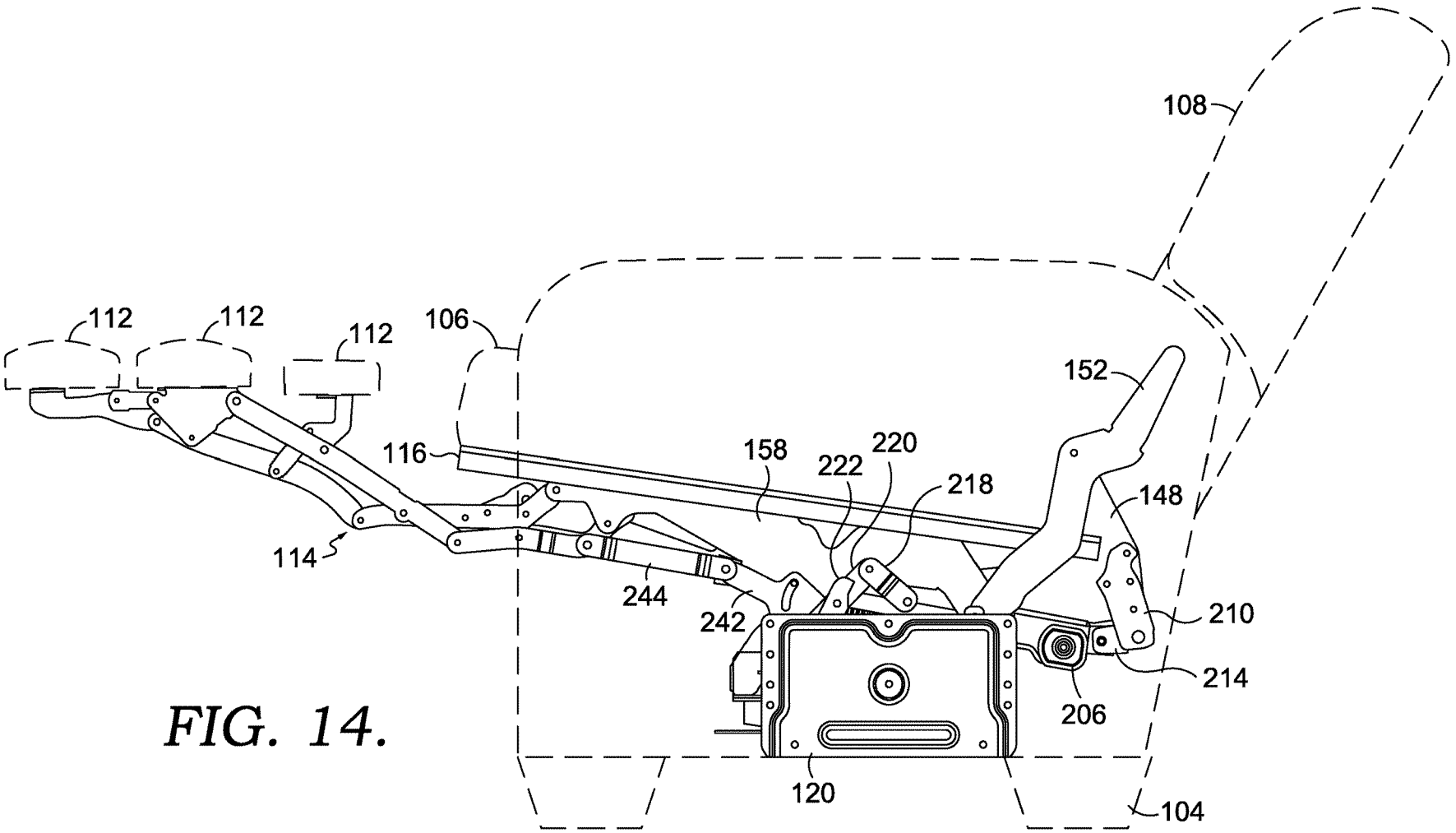
FIG. 14 is a side view of the rocker recliner in the fully reclined position, in accordance with aspects hereof.

FIGS. 8-17 illustrate views of the rocker recliner 100 in a closed position (FIG. 9), a TV position (FIG. 12), and a fully reclined position (FIG. 14). The upholstery of the seat 106, the back 108 and the ottomans 112 is shown in dashed lines in FIG. 14, for context. It should be understood that the upholstery of the rocker recliner 100 could take various other forms. The seat 106 is carried on a seat rail 116 connected to the full-recline linkage mechanism 110. The arms 102 and the legs 104 support the full-recline linkage mechanisms 110, the seat rail 116 and the seat 106 on the seating support surface 105. In one aspect, the legs 104 support the arms 102 and raise the arms 102 above the seating support surface 105. In other aspects, the arms 102 may contact the seating support surface 105 directly and the rocker recliner 100 may have no legs 104. The full-recline linkage mechanism 110 is coupled to the arms 102 through a rocker assembly 126 (see FIG. 11) to allow the seat 106, the back 108 and the ottoman(s) 112 to rock between the arms 102, and to actuate and control movement of the seat 106, the back 108, and the one or more ottomans 112 between the positions shown in FIGS. 8-17, as more fully described below.

Figure 10A:
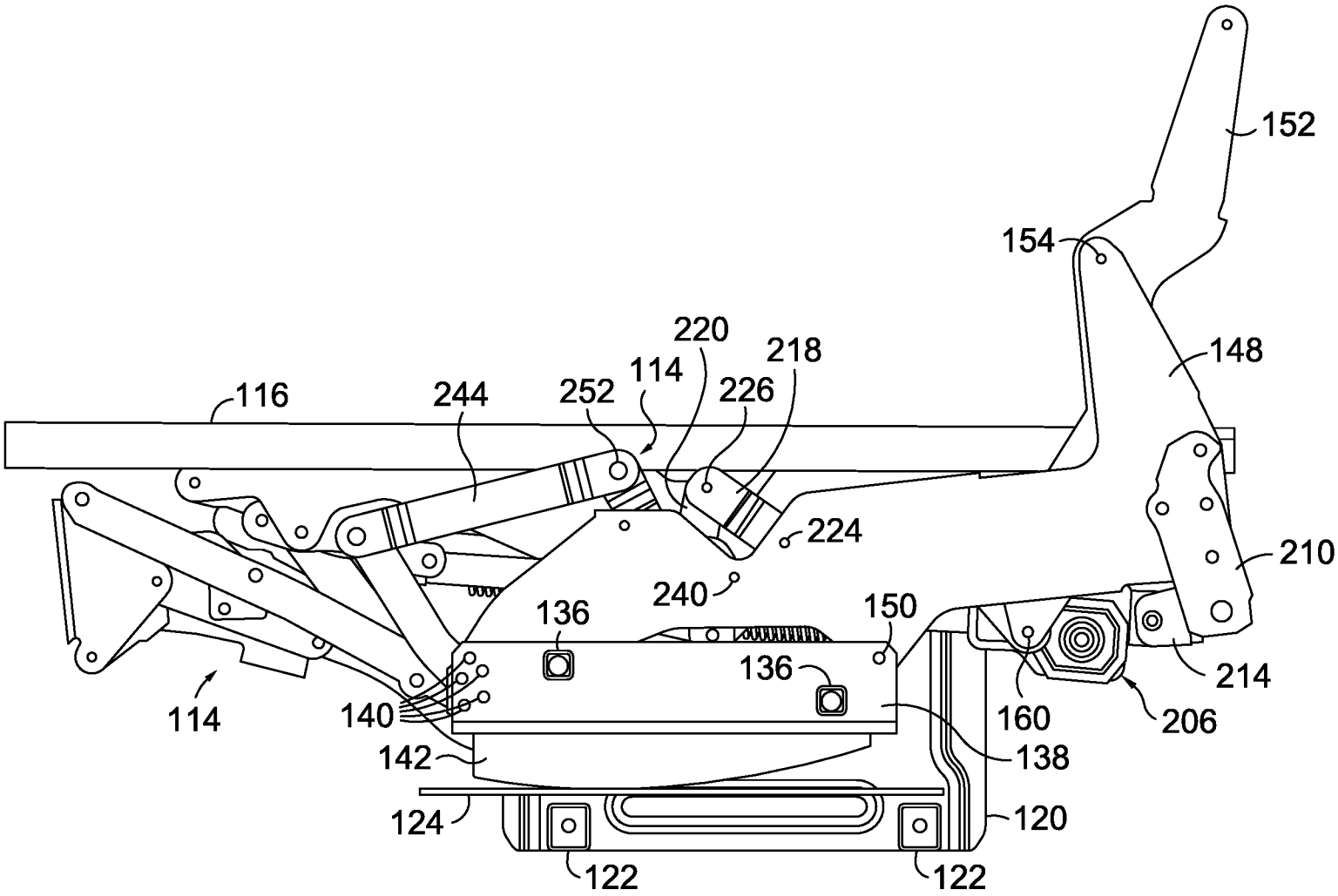
FIG. 10A shows the side view of FIG. 9, but with the chassis plate hidden to show other parts, in accordance with aspects hereof.
Figure 10B:
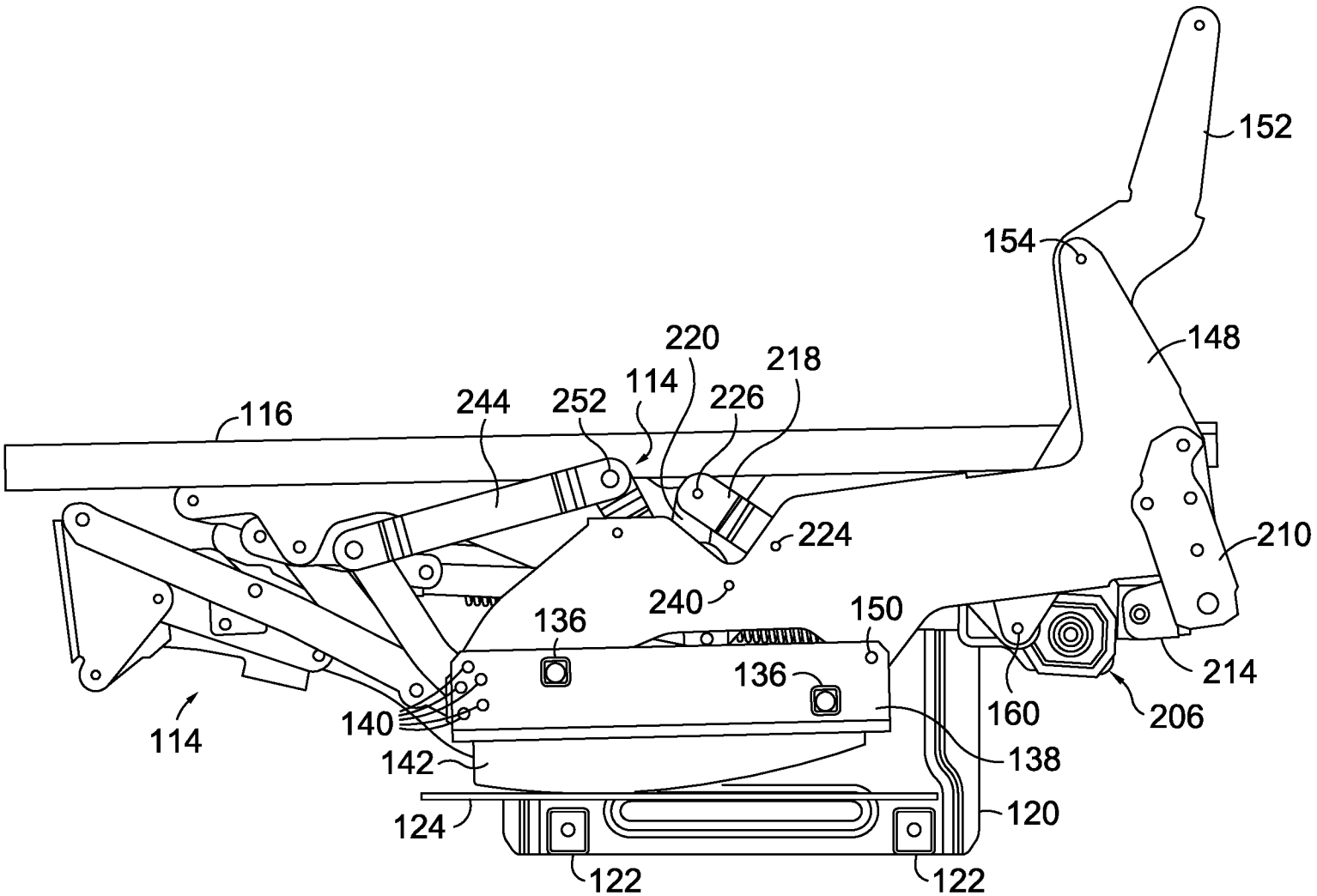
FIG. 10B is a view similar to FIG. 10A, but shown in a rocked forward positon, in accordance with aspects hereof.
Figure 10C:
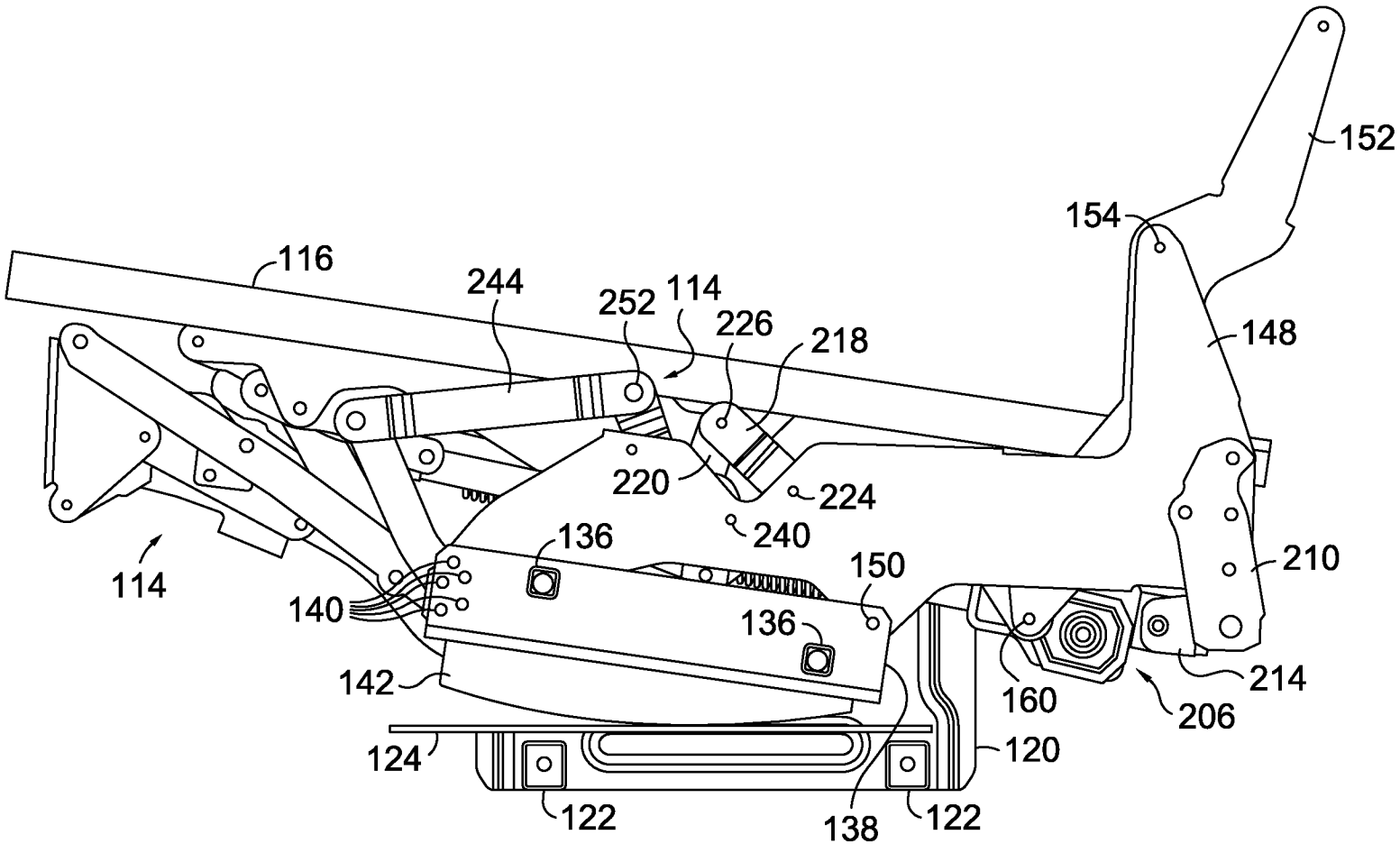
FIG. 10C is a view similar to FIG. 10A, but shown in a rocked rearward position, in accordance with aspects hereof.
Figure 11:
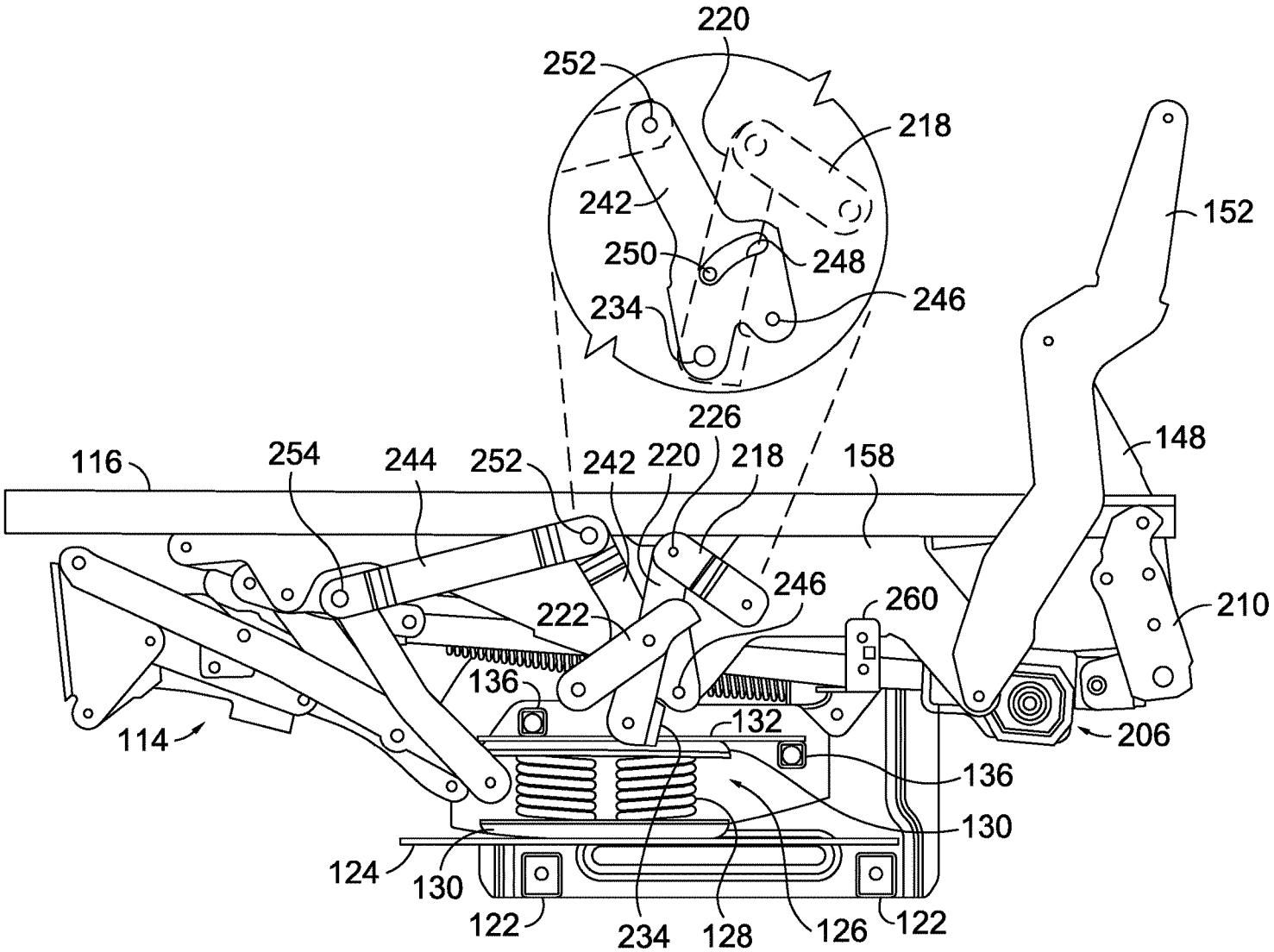
FIG. 11 is a view similar to FIG. 10A, with the cam angle bracket, wood cam and base plate hidden as well to show other parts, and with the lift link shown broken out in isolation, in accordance with aspects hereof.

As shown in FIGS. 9, 12 and 14, the rocker recliner 100 is adjustable to three basic positions. FIG. 9 depicts a closed position, which is a normal non-reclined sitting position with the seat 106 in a generally horizontal position and the back 108 substantially upright. In the closed position, the one or more ottomans 112 are positioned below the seat 106. FIG. 12 depicts a TV position (also referred to as an extended position in the furniture manufacturing industry) in which the one or more ottomans 112 are extended forward of the front of the rocker recliner 100 and disposed generally horizontal. Unlike the rocker recliner 10 shown in FIGS. 1-6, the rocker recliner 100 of FIGS. 8-17 is shown with multiple ottomans 112. In the TV position, the position of the seat 106 changes slightly with the front of the seat 106 raising more than the rear of the seat 106 (effectively changing the "pitch" of the seat 106). Further, in the TV position, the angle of inclination of the back 108 remains largely unchanged, and will not encroach an adjacent wall. FIG. 14 depicts a fully reclined position in which the seat 106 and the ottomans 112 have moved forward and upward. In the fully reclined position, the back 108 is rotated over the upper portion of the arm 102 in a rearward inclination angle. The rearward inclination angle of the fully reclined position causes the back 108 to move rearwardly to some degree. The rocker recliner 100, in the closed position of FIG. 10A can "rock" rearwardly, as shown in FIG. 10C and forwardly, as shown in FIG. 10B. During this rocking motion, as described in detail below, the seat 106, the back 108 and the ottomans 112 rock, while the arms 102 remain stationary. While not depicted, this same rocking motion is available in all positions of the rocker recliner 100, including the TV position and the fully reclined position.

Figure 17:
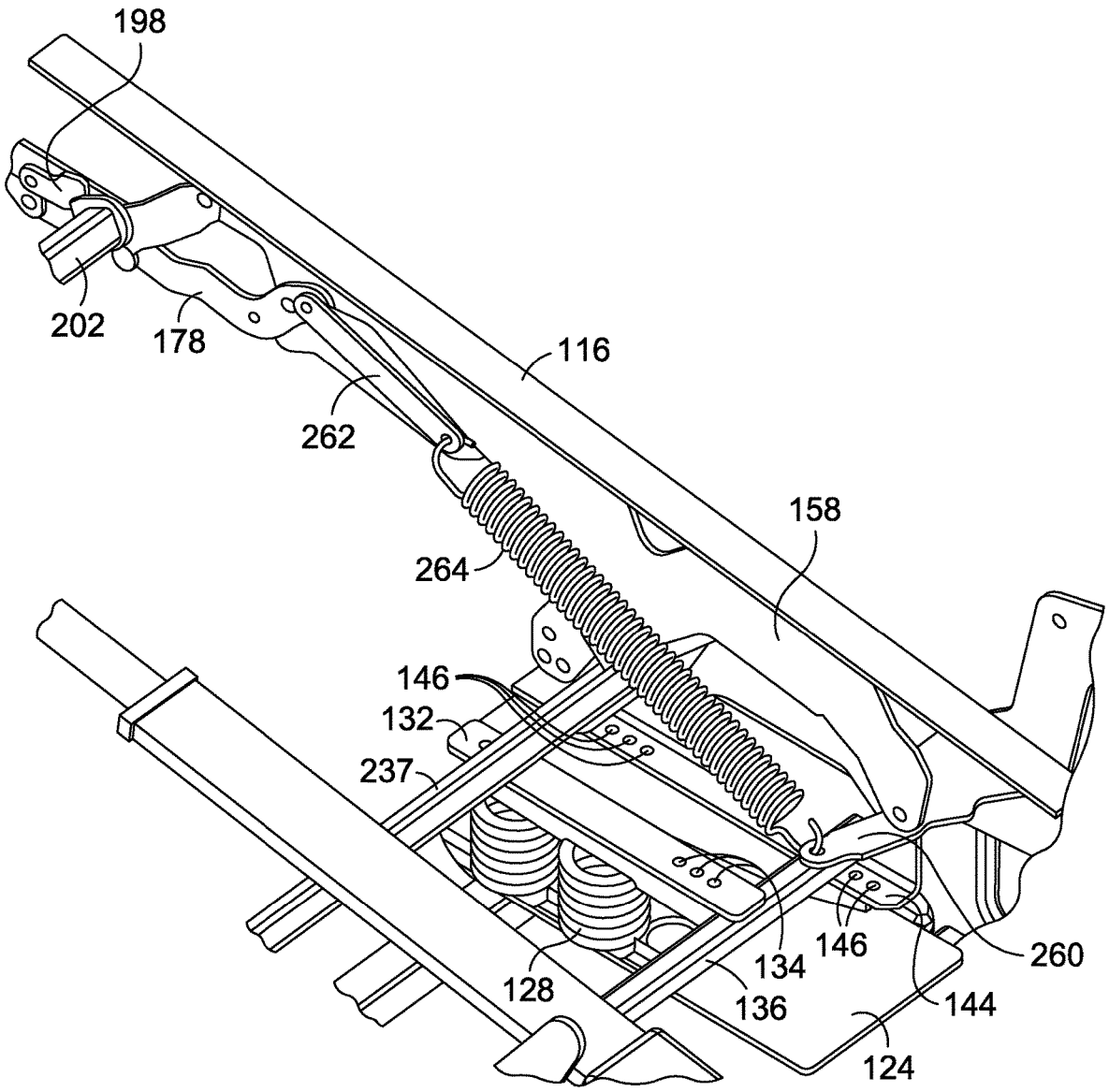
FIG. 17 is an enlarged view of the encircled region 17 in FIG. 16, in accordance with aspects hereof.

The rocker recliner 100 is more fully described below. Most of this discussion will describe one side of the rocker recliner 100, but it should be understood that much of the full-recline linkage mechanism 110 has a left side and a ride side that are mirror-images of each other. For simplicity, only one side is described below. As shown in FIGS. 9 and 11, the rocker recliner 100 has a chassis plate 120 coupled to an adjacent arm 102, and a pair of support tubes 122 that extend between arms 102 and that are coupled to the chassis plate 120. The support tubes 122 are coupled to and support a rocker plate 124. The tubes 122 can be, in one aspect, rigid steel or aluminum square tubes, and rocker plate 124 can be flat steel. The rocker plate 124 supports a rocker assembly 126, as shown in FIG. 11. The rocker assembly 126 may include the rocker plate 124 as well. A pair of springs 128 are held between an upper and a lower spring base 130. The upper spring base 130 is coupled to an upper rocker spring bracket 132, as best seen in FIGS. 11 and 17. As shown in FIG. 17, the upper rocker spring bracket 132 may have a series of mounting holes 134 that are used to couple the upper rocker spring bracket 132 to the upper spring base 130. The multiple mounting holes 134 allow the position of the springs 128 to be adjusted forwardly or rearwardly as desired for a different rocking "feel". As seen in FIG. 11, the upper rocker spring bracket 132 is also coupled to a pair of brace cross tubes 136. The outer ends of the brace cross tubes 136 are fixedly coupled to a cam angle bracket 138 as best seen in FIG. 10A. The cam angle bracket 138, in some aspects, has a series of spaced mounting holes 140, the importance of which is discussed below. The cam angle bracket 138 is also coupled to a rocker cam 142, having an arcuate lower surface that rests upon the rocker plate 124. In some aspects, the rocker cam 142 can be made of wood. As best seen in FIG. 17, the cam angle bracket 138 may also include a flange 144 with a series of mounting holes 146 that are used to couple the cam angle bracket 138 to the rocker cam 142. The series of mounting holes 146 allow the position of the cam angle bracket 138 to be adjusted relative to the rocker cam 142 to achieve a different rocking experience for a user. In some aspects, the rocker cam 142 is biased to the neutral position of FIG. 10A by the springs 128. The springs 128 provide a returning force when the rocker recliner 100 moves to a rearward rocking position (FIG. 10C) or a forward rocking position (FIG. 10B).

As seen in FIG. 10A, the full-recline linkage mechanism 110 includes a base plate 148 that is fixedly coupled to the cam angle bracket 138 at a rear connection point 150. As best seen in FIG. 13, the front of the base plate 148, in some aspects, has a series of mounting holes 156, one of which, along with a selected one of the mounting holes 140, is used to couple the front of the base plate 148 to the cam angle bracket 138. The multiple mounting holes 140 and the multiple mounting holes 156 allow the pitch of the rocker recliner 100, relative to the chassis plate 120 and the arms 102, to be adjusted. The base plate 148 carries the remainder of the full-recline linkage mechanism 110, and, through the coupling to the rocker assembly 126, allows the full-recline linkage mechanism 110 to rock forward and rearward in any of the closed position, the TV position or the fully reclined position. The base plate 148 extends from about the front of cam angle bracket 138 rearwardly to near the back of the rocker recliner 100. A back mounting bracket 152 is pivotally coupled to the upper rearward end of the base plate 148 at pivot point 154. The upper end of the back mounting bracket 152 is coupled to the back 108, such as with a KD bracket, allowing the back 108 to be easily assembled onto the back mounting bracket 152. The lower end of the back mounting bracket 152 is pivotally coupled to a seat plate 158 at pivot point 160.

Figure 15:
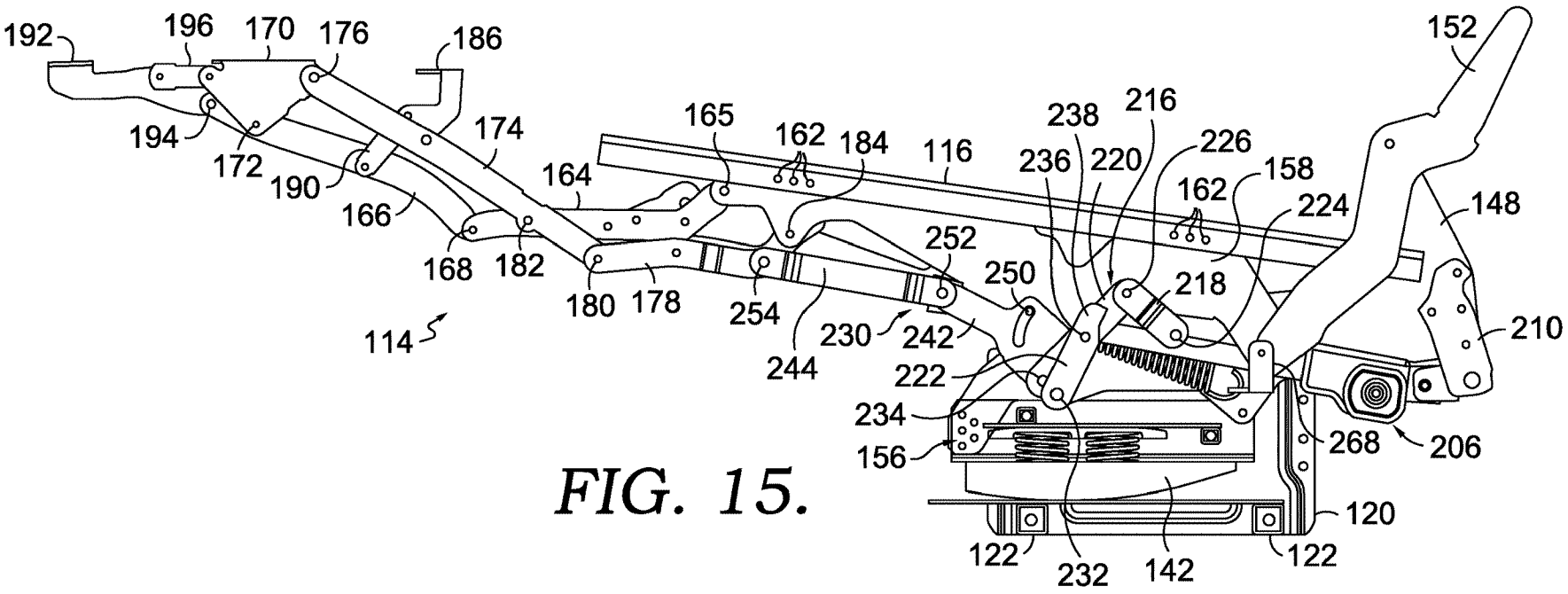
FIG. 15 is a view similar to FIG. 14 but with the chassis plate, wood cam, cam angle bracket and base plate all hidden to show other parts, in accordance with aspects hereof.

As best seen in FIG. 15, the seat plate 158 has a zig-zag shape and is fixedly coupled to the seat rail 116 at connection points 162. The forward end of the seat plate 158 is coupled to the footrest linkage assembly 114. More specifically, a front ottoman link 164 is pivotally coupled to the seat plate 158 at pivot point 165. The front ottoman link 164 extends away from pivot point 165 and is pivotally coupled at the opposite end to a lower ottoman link 166 at pivot point 168. Near the end of the lower ottoman link 166 opposite pivot point 168, a footrest bracket 170 is pivotally coupled to the lower ottoman link 166 at pivot point 172. The footrest bracket 170 is fixedly coupled to one of the ottomans 112. An upper ottoman link 174 is also pivotally coupled to the footrest bracket 170, at pivot point 176. The upper ottoman link 174 extends away from pivot point 176, and is pivotally coupled on the opposite end to a rear ottoman link 178 at pivot point 180. The upper ottoman link 174 is also pivotally coupled to the front ottoman link 164, at pivot point 182. The end of the rear ottoman link 178 opposite pivot point 180 is pivotally coupled to the seat plate 158 at pivot point 184. In some aspects, the footrest linkage assembly 114 also includes a mid-ottoman bracket 186 that is pivotally coupled to the upper ottoman link 174. As best seen in FIG. 15, a control link 190 is pivotally coupled on one end to the mid-ottoman bracket 186 and on the other end to the lower ottoman link 166. Additionally, in some aspects, the footrest linkage assembly may also have a flipper ottoman bracket 192 that is pivotally coupled to the end of the lower ottoman link 166 at pivot point 194. The flipper ottoman bracket 192 is pivotally coupled to the footrest bracket 170 via flipper control link 196.

Figure 16:
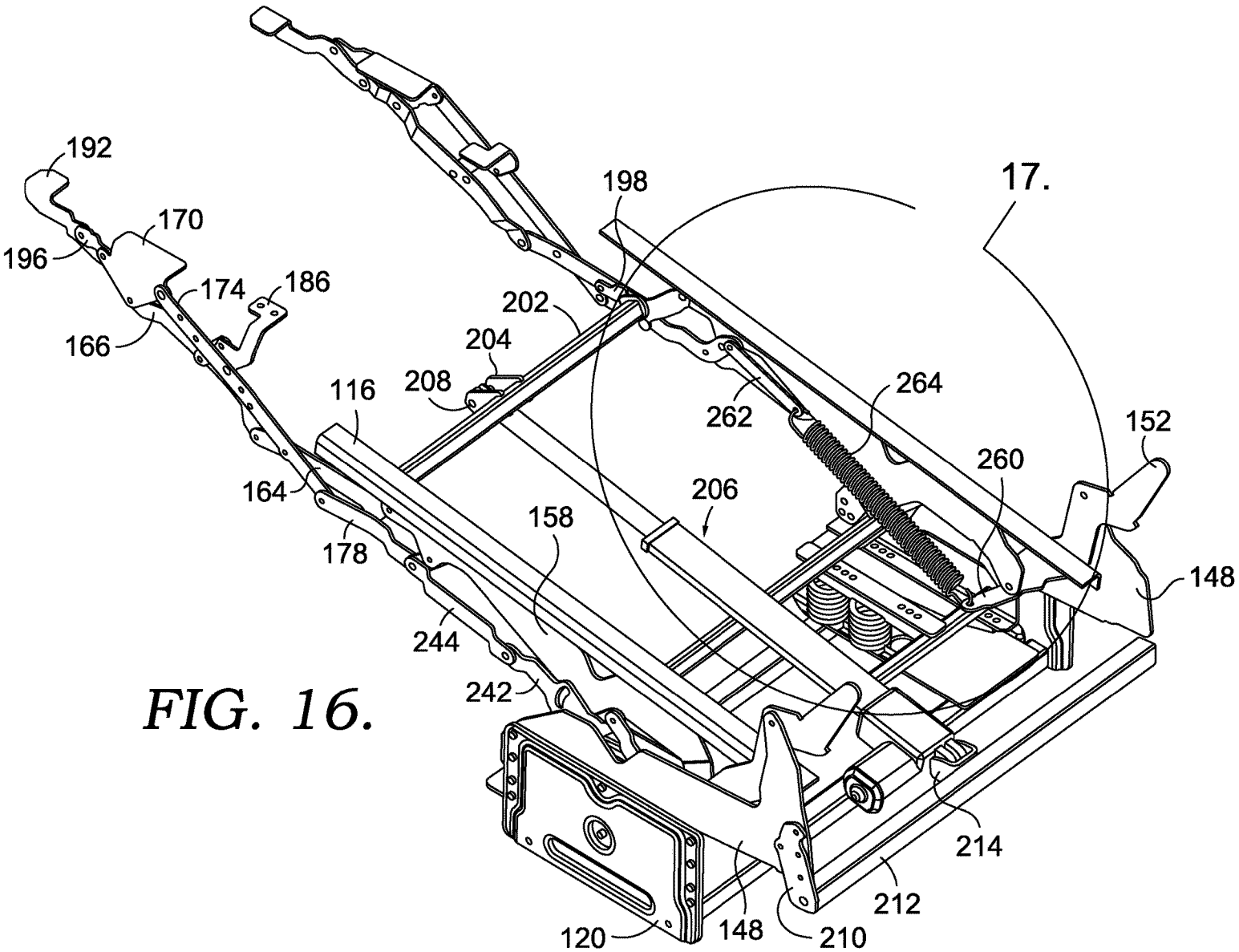
FIG. 16 is a perspective view of the rocker recliner mechanism in the fully reclined position, in accordance with aspects hereof.

As best seen in FIGS. 8 and 16, a front motor tube bracket 198 is fixedly coupled to the front ottoman link 164 at coupling points 200. The front motor tube bracket 198 extends away from coupling points 200 and is fixedly coupled to a front motor tube 202. The front motor tube 202 extends from one side of the rocker recliner 100 to the other, coupling together opposing front motor tube brackets 198. A clevis 204 is used to pivotally couple the front motor tube 202 to the shaft of a motor or linear actuator 206 at pivot point 208.

A rear motor tube bracket 210 is fixedly coupled to the base plate 148, such as by bolting or riveting. A rear motor tube 212 is fixedly coupled between opposing rear motor tube brackets 210, and thus extends from one side of rocker recliner 100 to the other. A clevis 214 is fixedly coupled to the rear motor tube 212, such as by welding. The clevis 214 is used to pivotally couple the rear end of the motor 206 to the rear motor tube 212.

As best seen in FIG. 15, a translation sub-linkage 216 is a part of the full recline linkage mechanism 110. The translation sub-linkage 216 includes a control link 218, a pivot link 220 and a pivot lift link 222. The control link 218 is pivotally coupled to the base plate 148 at pivot point 224. The control link 218 extends away from pivot point 224, and is pivotally coupled on the opposite end to the pivot link 220 at pivot point 226. The end of the pivot link 220 opposite pivot point 226 is pivotally coupled to a link on a lift sub-linkage 230 at pivot point 234. As best seen in FIG. 8, near pivot point 234, the pivot link 220 has an inwardly extending tab 235. The tab 235 is used to fixedly couple a sequence tube 237 between the pivot links 220 on each side of the full recline linkage mechanism 110. In some aspects, the sequence tube 237 has a downward bend near the middle to provide clearance for the motor 206. Returning to FIG. 15, the pivot lift link 222 is pivotally coupled on one end to base plate 148 at pivot point 232. The other end of the pivot lift link 222 is pivotally coupled to the pivot link 220 at pivot point 236, generally midway between pivot point 226 and pivot point 234. Additionally, in some aspects, the pivot lift link 220 has a finger 238 that projects rearwardly beyond pivot point 236. The finger 238 on the pivot lift link 220 contacts a stop 240 (see FIG. 10A) on the base plate 148 when the rocker recliner 100 is in the closed or TV positions.

In the aspect of FIGS. 8-17, the full recline linkage mechanism 110 includes the lift sub-linkage 230. As seen in FIG. 15, in some aspects, the lift sub-linkage 230 includes a lift link 242 and a lift control link 244. The lift link 242 is shown in isolation in FIG. 11 to better reveal the overall shape, having three arms extending from a central section. As described above, one end of the pivot link 220 is pivotally coupled to a link on a lift sub-linkage 230 at pivot point 234. More specifically, one end of the pivot link 220 is pivotally coupled to one arm of the lift link 242 at pivot point 234. As best seen in FIG. 11, the arm of the lift link 242 adjacent pivot point 234 is pivotally coupled to the seat plate 158 at pivot point 246. The central section of the lift link 242 has an arcuate slot 248 formed therein. The seat plate 158 has an extending pin 250 fixedly coupled to it, and extending from it, which extends through the slot 248. The pin 250 and the slot 248 constrain the pivoting motion of the lift link 242, with the pin 250 and the slot 248 essentially operating as stop surfaces. In the closed position, as seen in FIG. 11, the pin 250 is at the lower end of the slot 248. In the fully reclined position, as seen in FIG. 15, the pin 250 is at the upper end of the slot 248. The longer arm of the lift link 242 is pivotally coupled to one end of the lift control link 244 at pivot point 252. The opposite end of the lift control link 244 is pivotally coupled to the rear ottoman link 178 at pivot point 254.

As with the aspect described above regarding FIGS. 1-7, the rocker recliner 100 can be "rocked" rearwardly and forwardly, under operator power, relative to the arms 102. As described above, the rocker assembly 126 is biased to return to a neutral position by the springs 128. This rocking motion is achievable in any of the closed position, the TV position and the fully reclined position.

Figure 18:
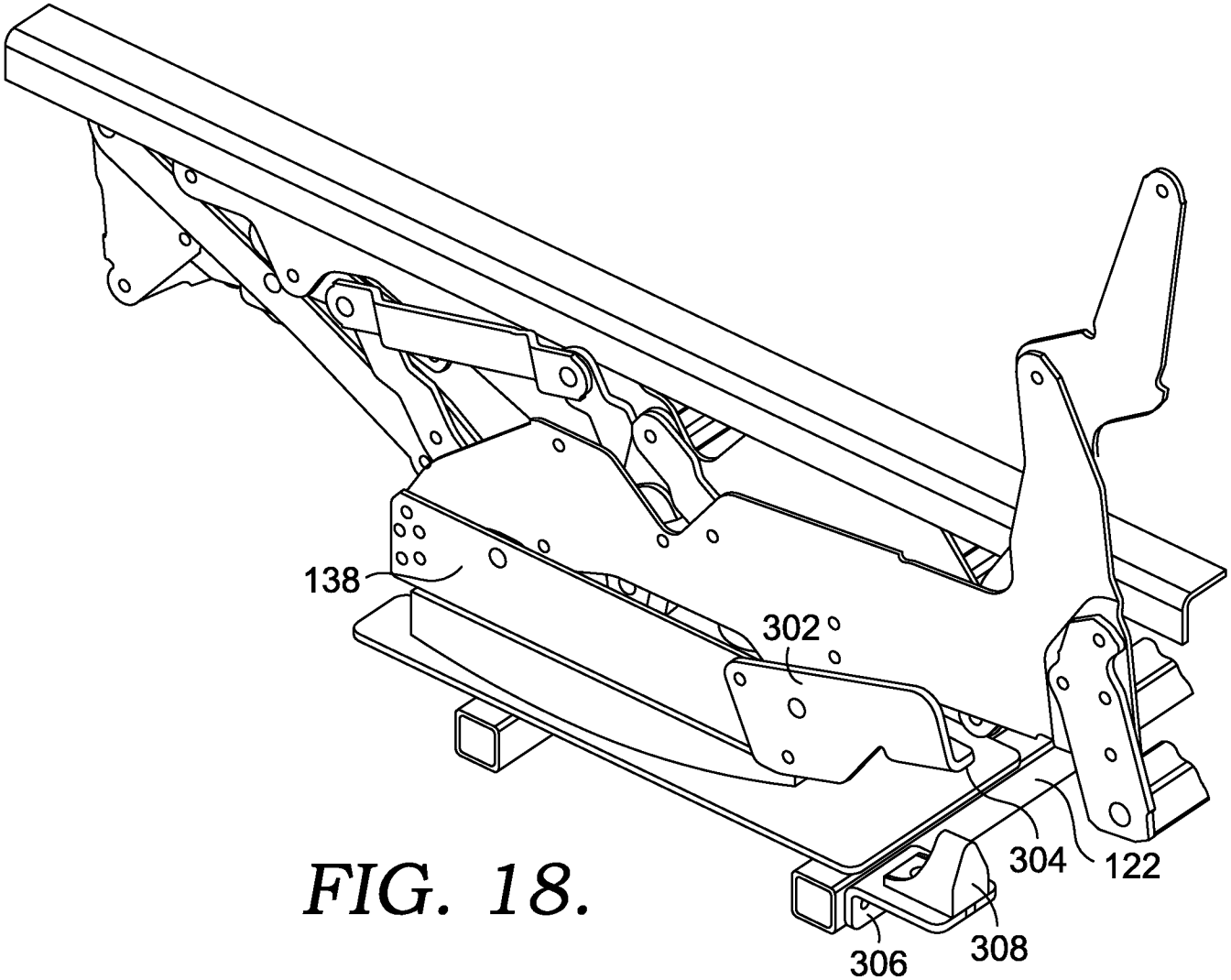
FIG. 18 is a perspective view of a portion of a rocker recliner mechanism, showing a rocker blocker assembly.
Figure 19:
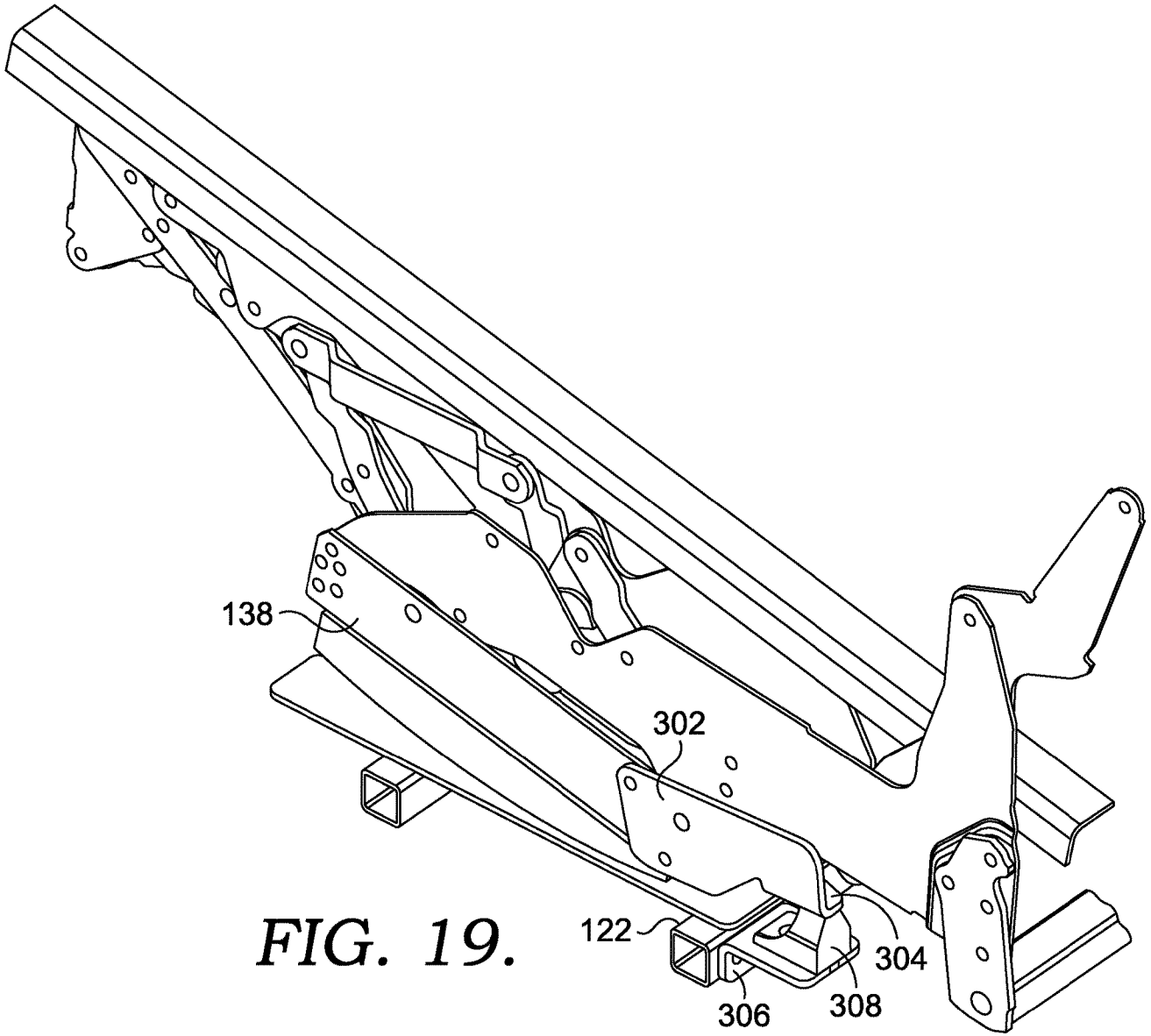
FIG. 19 is a view similar to FIG. 18, but showing a rearward rocked position.

In some aspects, the rocker recliner 10 of FIGS. 1-7 and/or the rocker recliner 100 of FIGS. 8-17 may have a rocker stop assembly to prevent a rearward rocking beyond a set position. This may be desirable to prevent the springs 128 from becoming over-stretched and provides a user confidence that the rocker recliner 10 or the rocker recliner 100 will not "over-rock". In one aspect, a rocker stop assembly is shown in FIGS. 18 and 19. The rocker stop assembly may include an upper blocker bracket 302 that is fixedly coupled to the cam angle bracket 138. The upper blocker bracket 302 extends rearwardly away from the cam angle bracket 138, and has an inwardly extending tab 304 integrally formed therein. The rocker stop assembly may also include a lower blocker bracket 306 that is fixedly coupled to the rear support tube 122. The lower blocker bracket 306 extends rearwardly away from the rear support tube 122. In one aspect, a bumper 308 is fixedly coupled to the lower blocker bracket 306 and extends upwardly from the lower blocker bracket 306. In some aspects, the bumper 308 is made of a slightly resilient material, such as rubber. As best seen in FIG. 19, if the user rocks rearwardly, the tab 304 of the upper blocker bracket 302 will contact the bumper 308 on the lower blocker bracket 306 to prevent further rearward rocking. The resiliency of the bumper 308 will soften the "feel" of the contact between the tab 304 and the bumper 308 so the user does not experience a hard stop.

To extend the footrest from the closed position to the TV position, the motor 206 is activated (such as with a push-button operator control) to extend the shaft of the motor 206. As the shaft of the motor 206 extends forwardly, the front motor tube 202 rotates, thus rotating the front ottoman link 164. As the front ottoman link 164 rotates about pivot point 165, the footrest linkage assembly 114 opens to the position shown in FIG. 12. In this position, the back 108 remains in substantially the same position and the front of the seat 106 raises relative to the back of the seat 106 (due to the lift sub-linkage 230). In the aspect shown in FIGS. 8-17, the lift sub-linkage 230 raises the front of the seat 106 (relative to the back of the seat 106) to increase the pitch of the seat 106 when moving from the closed position to the TV position. Some users may desire this greater pitch to alleviate any feelings of tipping. The lift sub-linkage 230 changes the center-of-gravity of the rocker recliner 100 when in the TV position, essentially counter-balancing the opening of the footrest linkage assembly 114 and preventing any forward tipping (or the feeling of forward tipping) of the rocker recliner 100. In some aspects, as best seen in FIG. 17, a lower spring bracket 260 may be fixedly coupled to the base plate 148. An upper spring bracket 262 may be pivotally coupled to the rear ottoman link 178. An extension spring 264 may then be coupled between the lower spring bracket 260 and the upper spring bracket 262. The spring 264 aids the sequencing of the lift sub-linkage 230 operating prior to the translation sub-linkage 216 (which operates as the rocker recliner 100 moves from the TV position to the fully-reclined position). The spring 264 may also assist the motor 206 in moving from the fully reclined position to the closed position. The rocker recliner 100 can rock forward and rearward while in the TV position of FIG. 12.

To move the rocker recliner 100 from the TV position to the fully reclined position, the motor 206 is again activated, to extend the shaft of the motor 206 farther. With the footrest linkage assembly 114 already open, the additional extension of the shaft of motor 206 pushes the seat plate 158 forwardly and upwardly. This motion is controlled by the pivot lift link 222, the pivot link 220 and the control link 218 of the translation sub-linkage 216. Additionally, as the seat plate 158 moves forwardly, it rotates back mounting bracket 152 about pivot point 154. This, in turn, reclines the back 108. Again, the rocker recliner 100 can be rocked forward and rearward while in the fully reclined position.

To move from the fully reclined position to the closed position, the above process is reversed.

The full-recline linkage mechanism 110, the chassis plate 120 and the rocker assembly 126 provide a simple, compact mechanism for a powered, rocker recliner that allows the seat 106, the back 108 and the ottomans 112 to rock backward and forward between the stationary arms 102 in any of a closed position, a TV position or a fully reclined position. This allows different styling options that may be favorable for customers that do not like the look and feel of a rocker in which the arms move with the seat and the back. Because the arms 102 are stationary, the described design allows for a "wood-to-the-floor" styling. Further, because the back 108 pivots over the arms 102, a "winged back" chair design is possible. Also, with the seat 106 moved forwardly in the TV position and the fully reclined position, a seat having a "T-cushion" styling is possible. Additionally, the rocker recliner 100 is not only a rocker, but a powered recliner mechanism as well, that allows a user powered movement between the closed, TV and fully reclined positions.

It will be understood that certain features and sub-combinations are of utility and may be employed without reference to other features or sub-combinations. This is contemplated by and is within the scope of the claims. The described technology may be made without departing from the scope, it is to be understood that all matter described herein or illustrated in the accompanying drawings is to be interpreted as illustrative and not in a limiting sense.

The present invention has been described in relation to particular examples, which are intended in all respects to be illustrative rather than restrictive. From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations.

The following clauses are aspects contemplated herein.

Clause 1. A powered rocker recliner, comprising: a pair of stationary arms; a seat disposed between the arms; at least one ottoman; a back pivotally coupled to the seat; a full-recline linkage mechanism coupling the ottoman, the seat and the back; an actuator coupled to the linkage mechanism, the actuator operable to move the ottoman, the seat and the back between a closed position, a TV position and a fully reclined position; and a rocker assembly coupled between the full-recline linkage mechanism and the stationary arms, allowing the seat, back and ottoman to rock between the stationary arms in any of the closed position, the TV position or the fully reclined position.

Clause 2. The rocker recliner of clause 1, wherein the full recline linkage mechanism indirectly pivotally couples the back to the seat, at a point above the seat.

Clause 3. The rocker recliner of any of clauses 1-2, wherein the back is shaped to have wings extending over the arms, and wherein the wings remain away from the arms when the seat, the back and the ottoman rock between the arms and when the full-recline linkage assembly moves the rocker recliner to a fully reclined position.

Clause 4. The rocker recliner of any of clauses 1-3, further comprising a plurality of legs affixed to the bottom of each arm, the legs spacing the arms above a surface on which the rocker recliner is supported.

Clause 5. The rocker recliner of any of clauses 1-4, wherein the full recline linkage assembly comprises a translation sub-linkage that translates the seat rail forwardly as the full recline linkage assembly moves to the fully reclined position.

Clause 6. The rocker recliner of any of clauses 1-5, wherein the full recline linkage assembly comprises a lift sub-linkage that changes a pitch of the seat rail, such that the front of the seat rail raises more than the back of the seat rail, as the full recline linkage assembly moves to the TV position.

Clause 7. The rocker recliner mechanism of any of clauses 1-6, wherein the full-recline linkage mechanism comprises: a chassis plate configured to fixedly attach to an arm of the rocker recliner; a support plate coupled to and supported by the chassis plate; a rocker cam having an arcuate lower surface, positioned on the support plate; a base plate coupled to the rocker cam; a back mounting bracket having a first end opposite a second end, the back mounting bracket pivotally coupled to the base plate between the first end and the second end, the first end being configured for coupling to the back of the rocker recliner; a seat rail being configured for coupling to the seat of the rocker recliner; a seat plate having a front region, a center region and a back region, the back region of the seat plate pivotally coupled to the second end of the back mounting bracket and at least one of the front region or the center region coupled to the seat rail; and a full recline linkage assembly coupled to the seat plate, the base plate and the back mounting bracket, and operable to position the rocker recliner between a closed position, a TV position, or a forward position; wherein the base plate supports a rocking motion of the footrest, the seat and the back in any position between the closed position and the fully reclined position with the arms in a stationary state.

Clause 8. The recliner mechanism of any of clauses 1-7, wherein the rocker cam comprises a lower cam section and an upper cam angle bracket, wherein the rocker cam is coupled to the base plate via the upper cam angle bracket, and wherein the upper cam angle bracket has a plurality of mounting holes that allow adjustment of the position of the upper cam angle bracket relative to the lower cam section.

Clause 9. The recliner mechanism of any of clauses 1-8, wherein the back mounting bracket is pivotally coupled to the base plate a distance above the seat rail, allowing the back of the rocker recliner to pivot over the stationary arms of the rocker recliner.

Clause 10. The recliner mechanism of any of clauses 1-9, wherein the full recline linkage assembly changes the center of gravity of the rocker recliner as the full recline linkage assembly moves to the TV position to counter-balance the opening of the footrest in the TV position.

Clause 11. A powered rocker recliner, comprising: a pair of spaced apart stationary arms; a seat disposed between the spaced apart arms; at least one ottoman; a back pivotally coupled to the seat; a full-recline linkage mechanism coupling the ottoman, the seat and the back; an actuator coupled to the linkage mechanism, the actuator operable to move the ottoman, the seat and the back in any position between a closed position and a fully reclined position; and a rocker assembly coupled between the full-recline linkage mechanism and the stationary arms, allowing the seat, back and ottoman to rock between the stationary arms with the seat, back and ottoman in any position.

Clause 12. The recliner mechanism of clause 11, wherein the full recline linkage mechanism indirectly pivotally couples the back to the seat, at a point above the seat.

Clause 13. The recliner mechanism of any of clauses 11-12, wherein the back is shaped to have wings extending over the arms, and wherein the wings remain away from the arms when the seat, the back and the ottoman rock between the arms and when the full-recline linkage assembly moves the rocker recliner to a fully reclined position.

Clause 14. The recliner mechanism of any of clauses 11-13, further comprising a plurality of legs affixed to the bottom of each arm, the legs spacing the arms above a surface on which the rocker recliner is supported.

Clause 15. The rocker recliner of any of clauses 11-14, wherein the full recline linkage assembly comprises a translation sub-linkage that translates the seat rail forwardly as the full recline linkage assembly moves to the fully reclined position.

Clause 16. The rocker recliner of any of clauses 11-15, wherein the full recline linkage assembly comprises a lift sub-linkage that changes a pitch of the seat rail, such that the front of the seat rail raises more than the back of the seat rail, as the full recline linkage assembly moves to the TV position.

Clause 17. The rocker recliner of any of clauses 11-16, wherein the full-recline linkage mechanism comprises: a chassis plate configured to fixedly attach to an arm of the rocker recliner; a support plate coupled to and supported by the chassis plate; a rocker cam having an arcuate lower surface, positioned on the support plate; a base plate coupled to the rocker cam; a back mounting bracket having a first end opposite a second end, the back mounting bracket pivotally coupled to the base plate between the first end and the second end, the first end being configured for coupling to the back of the rocker recliner; a seat rail being configured for coupling to the seat of the rocker recliner; a seat plate having a front region, a center region and a back region, the back region of the seat plate pivotally coupled to the second end of the back mounting bracket and at least one of the front region or the center region coupled to the seat rail; and a full recline linkage assembly coupled to the seat plate, the base plate and the back mounting bracket, and operable to position the rocker recliner between a closed position, a TV position, or a forward position; wherein the base plate supports a rocking motion of the footrest, the seat and the back in any position between the closed position and the fully reclined position with the arms in a stationary state.

Clause 18. The rocker recliner of any of clauses 11-17, wherein the rocker cam comprises a lower cam section and an upper cam angle bracket, wherein the rocker cam is coupled to the base plate via the upper cam angle bracket, and wherein the upper cam angle bracket has a plurality of mounting holes that allow adjustment of the position of the upper cam angle bracket relative to the lower cam section.

Clause 19. The rocker recliner of any of clauses 11-18, wherein the back mounting bracket is pivotally coupled to the base plate a distance above the seat rail, allowing the back of the rocker recliner to pivot over the stationary arms of the rocker recliner.

Clause 20. The rocker recliner of any of clauses 11-19, wherein the full recline linkage assembly changes the center of gravity of the rocker recliner as the full recline linkage assembly moves to the TV position to counter-balance the opening of the footrest in the TV position.

What is claimed:

1. A powered rocker recliner, comprising:

a pair of stationary arms;

a seat disposed between the arms;

at least one ottoman;

a back pivotally coupled to the seat;

a full-recline linkage mechanism coupling the ottoman, the seat and the back;

an actuator coupled to the linkage mechanism, the actuator operable to move the ottoman, the seat and the back between a closed position, a TV position and a fully reclined position; and a rocker assembly coupled between the full-recline linkage mechanism and the stationary arms, allowing the seat, back and ottoman to rock between the stationary arms in any of the closed position, the TV position or the fully reclined position.

2. The rocker recliner of claim 1, wherein the full recline linkage mechanism indirectly pivotally couples the back to the seat, at a point above the seat.

3. The rocker recliner of claim 2, wherein the back is shaped to have wings extending over the arms, and wherein the wings remain away from the arms when the seat, the back and the ottoman rock between the arms and when the full-recline linkage assembly moves the rocker recliner to a fully reclined position.

4. The rocker recliner of claim 1, further comprising a plurality of legs affixed to the bottom of each arm, the legs spacing the arms above a surface on which the rocker recliner is supported.

5. The rocker recliner of claim 1, wherein the full recline linkage assembly comprises a translation sub-linkage that translates the seat rail forwardly as the full recline linkage assembly moves to the fully reclined position.

6. The rocker recliner of claim 1, wherein the full recline linkage assembly comprises a lift sub-linkage that changes a pitch of the seat rail, such that the front of the seat rail raises more than the back of the seat rail, as the full recline linkage assembly moves to the TV position.

7. The rocker recliner of claim 1, wherein the full-recline linkage mechanism comprises:

a chassis plate configured to fixedly attach to an arm of the rocker recliner;

a support plate coupled to and supported by the chassis plate;

a rocker cam having an arcuate lower surface, positioned on the support plate;

a base plate coupled to the rocker cam;

a back mounting bracket having a first end opposite a second end, the back mounting bracket pivotally coupled to the base plate between the first end and the second end, the first end being configured for coupling to the back of the rocker recliner;

a seat rail being configured for coupling to the seat of the rocker recliner;

a seat plate having a front region, a center region and a back region, the back region of the seat plate pivotally coupled to the second end of the back mounting bracket and at least one of the front region or the center region coupled to the seat rail; and a full recline linkage assembly coupled to the seat plate, the base plate and the back mounting bracket, and operable to position the rocker recliner between a closed position, a TV position, or a forward position;

wherein the base plate supports a rocking motion of the footrest, the seat and the back in any position between the closed position and the fully reclined position with the arms in a stationary state.

8. The recliner mechanism of claim 7, wherein the rocker cam comprises a lower cam section and an upper cam angle bracket, wherein the rocker cam is coupled to the base plate via the upper cam angle bracket, and wherein the upper cam angle bracket has a plurality of mounting holes that allow adjustment of the position of the upper cam angle bracket relative to the lower cam section.

9. The recliner mechanism of claim 8, wherein the back mounting bracket is pivotally coupled to the base plate a distance above the seat rail, allowing the back of the rocker recliner to pivot over the stationary arms of the rocker recliner.

10. The recliner mechanism of claim 9, wherein the full recline linkage assembly changes the center of gravity of the rocker recliner as the full recline linkage assembly moves to the TV position to counter-balance the opening of the footrest in the TV position.

11. A powered rocker recliner, comprising:

a pair of spaced apart stationary arms;

a seat disposed between the spaced apart arms;

at least one ottoman;

a back pivotally coupled to the seat;

a full-recline linkage mechanism coupling the ottoman, the seat and the back;

an actuator coupled to the linkage mechanism, the actuator operable to move the ottoman, the seat and the back in any position between a closed position and a fully reclined position; and a rocker assembly coupled between the full-recline linkage mechanism and the stationary arms, allowing the seat, back and ottoman to rock between the stationary arms with the seat, back and ottoman in any position.

12. The rocker recliner of claim 11, wherein the full recline linkage mechanism indirectly pivotally couples the back to the seat, at a point above the seat.

13. The rocker recliner of claim 12, wherein the back is shaped to have wings extending over the arms, and wherein the wings remain away from the arms when the seat, the back and the ottoman rock between the arms and when the full-recline linkage assembly moves the rocker recliner to a fully reclined position.

14. The rocker recliner of claim 11, further comprising a plurality of legs affixed to the bottom of each arm, the legs spacing the arms above a surface on which the rocker recliner is supported.

15. The rocker recliner of claim 11, wherein the full recline linkage assembly comprises a translation sub-linkage that translates the seat rail forwardly as the full recline linkage assembly moves to the fully reclined position.

16. The rocker recliner of claim 11, wherein the full recline linkage assembly comprises a lift sub-linkage that changes a pitch of the seat rail, such that the front of the seat rail raises more than the back of the seat rail, as the full recline linkage assembly moves to the TV position.

17. The rocker recliner of claim 11, wherein the full-recline linkage mechanism comprises:

a chassis plate configured to fixedly attach to an arm of the rocker recliner;

a support plate coupled to and supported by the chassis plate;

a rocker cam having an arcuate lower surface, positioned on the support plate;

a base plate coupled to the rocker cam;

a back mounting bracket having a first end opposite a second end, the back mounting bracket pivotally coupled to the base plate between the first end and the second end, the first end being configured for coupling to the back of the rocker recliner;

a seat rail being configured for coupling to the seat of the rocker recliner;

a seat plate having a front region, a center region and a back region, the back region of the seat plate pivotally coupled to the second end of the back mounting bracket and at least one of the front region or the center region coupled to the seat rail; and a full recline linkage assembly coupled to the seat plate, the base plate and the back mounting bracket, and operable to position the rocker recliner between a closed position, a TV position, or a forward position;

wherein the base plate supports a rocking motion of the footrest, the seat and the back in any position between the closed position and the fully reclined position with the arms in a stationary state.

18. The recliner mechanism of claim 17, wherein the rocker cam comprises a lower cam section and an upper cam angle bracket, wherein the rocker cam is coupled to the base plate via the upper cam angle bracket, and wherein the upper cam angle bracket has a plurality of mounting holes that allow adjustment of the position of the upper cam angle bracket relative to the lower cam section.

19. The recliner mechanism of claim 18, wherein the back mounting bracket is pivotally coupled to the base plate a distance above the seat rail, allowing the back of the rocker recliner to pivot over the stationary arms of the rocker recliner.

20. The recliner mechanism of claim 19, wherein the full recline linkage assembly changes the center of gravity of the rocker recliner as the full recline linkage assembly moves to the TV position to counter-balance the opening of the footrest in the TV position.

* * * * *